US011022389B2

(12) United States Patent
Aubin et al.

(10) Patent No.: US 11,022,389 B2
(45) Date of Patent: Jun. 1, 2021

(54) GAS OPERATING SYSTEM FOR AN AUTOMATIC FIREARM

(71) Applicant: Sig Sauer, Inc., Newington, NH (US)

(72) Inventors: Douglas Aubin, Newmarket, NH (US); David Michael Wilkes, Deerfield, NH (US); Aaron C. Sakash, Somersworth, NH (US); Lindsay Bunch, Newington, NH (US)

(73) Assignee: SIG SAUER, INC., Newington, NH (US)

( * ) Notice: Subject to any disclaimer, the term of this patent is extended or adjusted under 35 U.S.C. 154(b) by 18 days.

(21) Appl. No.: 16/253,706

(22) Filed: Jan. 22, 2019

(65) Prior Publication Data

US 2020/0025476 A1 Jan. 23, 2020

Related U.S. Application Data

(60) Provisional application No. 62/620,290, filed on Jan. 22, 2018.

(51) Int. Cl.
*F41A 5/26* (2006.01)

(52) U.S. Cl.
CPC ..... *F41A 5/26* (2013.01)

(58) Field of Classification Search
CPC ..... F41A 5/18; F41A 5/24; F41A 5/26
See application file for complete search history.

(56) References Cited

U.S. PATENT DOCUMENTS 1,187,032 A 6/1942 Garand
2015/0184960 A1* 7/2015 Monveldt ..... F41A 5/26 89/193

OTHER PUBLICATIONS

"Flash Suppressor," Wikipedia, originally downloaded from the Internet on Nov. 7, 2017. 3 pages.
"Gas-operated reloading," Wikipedia, originally downloaded from the Internet on Nov. 7, 2017. 3 pages.
"Gun barrel," Wikipedia, originally downloaded from the Internet on Nov. 13, 2017. 3 pages.
"M1 Garand," Wikipedia, originally downloaded from the internet on Oct. 31, 2017. 12 pages.
"Compak-16", Arms Tech Limited, retrieved on Jun. 2019, retrieved online at URL: http://www.armstechltd.com/products.php?id=compak16, 3 pages.

* cited by examiner

*Primary Examiner* — J. Woodrow Eldred
(74) *Attorney, Agent, or Firm* — Finch & Maloney PLLC

(57) ABSTRACT

Techniques and architectures are disclosed for a gas operating system for a firearm. The system includes a barrel having a bore including a rifled portion. Attached to the barrel is a gas block. Located distally of the rifled portion of the bore is a gas expansion chamber in fluid communication with the bore and the gas block. In some examples, the gas expansion chamber includes a diameter at least twice the bore diameter. The gas block of the gas operating system, in some examples, includes a piston, where in response to receiving gases from the gas expansion chamber, the piston cycles the gas operating system.

11 Claims, 21 Drawing Sheets

Initial

After 1,200 Rounds

After 2,400 Rounds

After 3,600 Rounds

After 4,800 Rounds

After 6,000 Rounds

After 5,000 Rounds

After 5,000 Rounds

GAS OPERATING SYSTEM FOR AN AUTOMATIC FIREARM

RELATED APPLICATIONS

This application claims priority under 35 U.S.C. § 119(e) to U.S. Provisional Patent Application No. 62/620,290 titled GAS OPERATING SYSTEM FOR AN AUTOMATIC FIREARM and filed on Jan. 22, 2018, the contents of which are incorporated herein by reference in its entirety.

FIELD OF THE DISCLOSURE

This disclosure relates to firearms, and more particularly to gas-operated firearms with automatic-firing capabilities.

BACKGROUND

During the firing of a firearm, combustion gases move the bullet through the barrel until it exits the bore at the muzzle-end of the barrel. Gas-operated firearms include a gas port located along the barrel of the firearm to receive combustion gases produced during the firing cycle. Pressurized gases enter the gas port to automatically reload the firearm. Movement of system components causes a spent cartridge to be ejected from the chamber of the firearm, and a new cartridge to be subsequently loaded therein. With the new cartridge loaded, the firearm is readied for the next firing cycle.

SUMMARY

The present disclosure provides a gas operating system for a firearm. In accordance with one embodiment, a gas operating system includes a barrel having a bore that includes a rifled portion of a first diameter. A gas block is attached to the distal end portion of the barrel. The gas operating system defines a gas expansion chamber located distally of the rifled bore portion, where the gas expansion chamber is in fluid communication with the bore and the gas block. The present disclosure also provides a firearm including the gas operating system, in accordance with some embodiments. For example, the firearm is chambered for 5.56×45 mm ammunition and has a barrel length from five to nine inches. The gas operating system can include a piston configured to cycle the action of the firearm in response to gas pressure generated during the firing cycle. Numerous variations and configurations will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
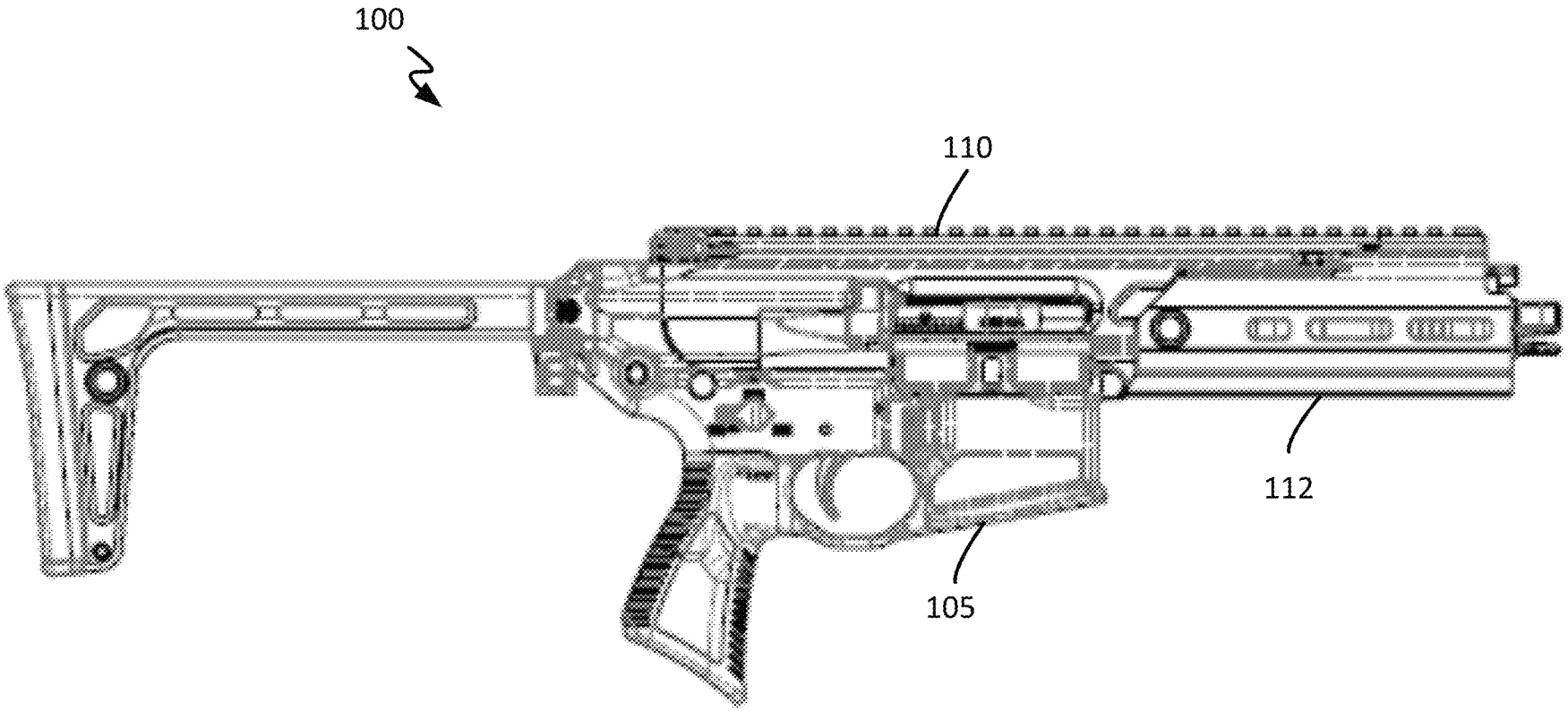
FIG. 1A is a side view of a firearm including a gas operating system configured in accordance with an embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

Techniques and architectures are disclosed for a gas operating system for a firearm, such as a short-barreled automatic rifle. The gas operating system is configured to utilize combustion gases generated by a cartridge during firing to automatically ready the firearm for its next firing cycle. The system includes a barrel having a bore through which a projectile can pass. The bore is rifled along its length to its opening at a distal end, in accordance with some embodiments. A gas block is attached to the distal end of the barrel. The gas block includes a piston and a gas port that communicates with the bore. In response to receiving pressurized gases from the gas port, the piston moves to cycle the action. Distally adjacent to the rifled portion of the bore, and axially aligned with the bore, is a chamber, for example gas expansion chamber. Combustion gases from the barrel enter the gas expansion chamber where they cool and expand to some extent after leaving the distal end of the barrel. The expansion of the combustion gases within the gas expansion chamber decreases the pressure, temperature, and/or velocity of the gases, and thereby reduces gas port erosion that adversely affects firearm durability, accuracy and/or performance of the firearm. Thus, the gas operating system in accordance with some embodiments of the present disclosure enables the firearm to achieve or exceed its designed service life by reducing or otherwise eliminating gas port erosion that necessitates repair of the firearm.

General Overview

As discussed above, gas-operated firearms can include a gas port within the barrel. The gas port, however, can erode or otherwise deform over time after repeated firing cycles. Gas port erosion is a particular concern for short-barreled firearms (e.g., rifles having barrels of less than nine inches in length) that fire rifle-caliber ammunition (e.g., 5.56×45 mm ammunition). Erosion of the gas port significantly reduces the life of the barrel, and thereby necessitates its repair or replacement at an earlier stage. In more detail, a shorter barrel means that the combustion gases enter the gas port at a higher pressure, velocity and/or temperature because the gas port is located closer to the cartridge chamber than in long-barreled rifles. In addition, the rifle-caliber cartridges produce combustion gases at greater pressures, temperatures, and/or velocities than smaller cartridges (e.g., pistol cartridges) because the rifle cartridge include a larger propellant charge. Together, the shorter barrel lengths and firing rifle cartridges cause high pressure, high velocity, and/or high temperature combustion gases to enter the gas port, and thereby rapidly wear down surfaces of the gas port. In some instances, for example, the erosion of the gas port can damage the rifling within the barrel, for example by creating a void in the rifling. The void in the rifling causes an interruption within the rifling of the barrel, in which the projectile is unsupported. As a result, contact between the projectile and damaged rifled surfaces damages the jacket of the projectile as it moves through the barrel. In turn, the damaged jacket causes the projectile to fly inaccurately through the air once the projectile exits the barrel. In other instances, erosion of the gas port can increase its effective diameter, and thereby allow more combustion gases through the port. The additional combustion gases increase the pressure acting on the piston of the gas operating, causing the gas operated system to cycle more quickly and with greater force than designed. As a result, gas operating system components wear more quickly and need replacement because the faster moving components apply greater force against each other.

Thus, and in accordance with an embodiment of the present disclosure, techniques and architectures are disclosed for a gas operating system, for example a direct impingement or gas piston system, for a firearm, such as a short-barreled automatic rifle. The gas operating system in accordance with some embodiments of the present disclosure is configured to utilize combustion gases generated by a cartridge during firing to automatically ready the firearm for its next firing cycle. In more detail, the system can include a barrel (e.g., a barrel with a length of 5.5 inches) having a bore including a rifled portion that provides a pathway for a projectile (e.g., a 5.56 mm rifle projectile). Attached to the barrel is a gas block that provides fluid communication between the barrel and the piston of the gas operating system. The gas block, in some examples, is adjacent to a muzzle-end of the barrel. The gas block can be concentric about a portion of the barrel, such that the overall length of the firearm is not increased by installation of the gas block thereon.

In one embodiment, the gas block includes a lower cylinder and an upper cylinder. The lower cylinder is configured to receive a portion of the barrel. For example, the lower cylinder is configured to receive the barrel, such that the barrel extends through the lower cylinder and extends beyond the distal end of the gas block's lower cylinder. In some other examples, the lower cylinder is further configured to receive an insert, for example a flash hider or suppressor. The upper cylinder of the gas block, on the other hand, is configured to receive a piston and a valve, such that the piston can move within the gas block to initiate reloading of the firearm. Disposed between the upper and lower cylinders is a gas port, such as a gas block port. The gas block port is configured to supply combustion gases generated by the cartridge to the valve to move the piston to cycle the gas operating system.

Adjacent to the rifled portion of the bore is a chamber, for example a gas expansion chamber. The gas expansion chamber can be aligned with the bore axis. The gas expansion chamber receives combustion gases from the bore and supplies the gases to the gas port to cycle the gas operating system. The gas expansion chamber is further configured with sufficient volume to allow the combustion gases to expand and flow within the chamber before entering the gas port. The expansion of the combustion gases within the chamber decreases the pressure, temperature, and/or velocity of the gases, and thereby reduces gas port erosion that adversely affects firearm accuracy and/or performance. The gas expansion chamber, in some examples, can be integrated within the barrel of the firearm such that a volume of the chamber is defined by the barrel. To this end, in some examples, the gas expansion chamber includes an average diameter that is at least two, three or four times the bore diameter of the barrel. In some cases, the maximum diameter of the chamber can be two, three or four times the diameter of the bore. In some cases, the axial length of the gas expansion chamber along the bore axis can be less than the length of the projectile that passes through the barrel.

In yet other examples, the gas expansion chamber can have a volume defined by a combination of the barrel (e.g., the muzzle-end of the barrel), the gas block, and/or an insert. In one example, the insert is axially aligned with the barrel and the gas block to form a pathway in which the projectile can travel to exit the firearm. Moreover, the insert can be removably attached to either the barrel or the gas block, depending on a given application. In addition, the insert can be further configured to enable flow of gases within the gas expansion chamber to generate regions of reduced pressure, temperature, and/or gas velocity. For instance, the insert may include one or more control surfaces that re-direct the flow of gases as they expand within the gas expansion chamber. In some examples, this may include guiding the gas flow within the gas expansion chamber so as to limit or otherwise prevent high-pressure gases that enter the gas expansion chamber from enveloping or otherwise surrounding the projectile as the projectile moves through the gas expansion chamber. This can be significant, because high-pressure gases that impinge upon the projectile can cause the projectile to move off its intended trajectory, thereby reducing accuracy of the firearm. In addition, the insert can be configured or otherwise positioned relative to the barrel such that part of the projectile enters the insert before the entire projectile completely exits the barrel. In other words, the projectile can bridge the gap between the barrel and the insert so as to prevent the expansion of high-pressure combustion gases within the gas expansion chamber from surrounding or otherwise engulfing the projectile. Such feature can be used to maintain firearm accuracy while the projectile moves through the firearm. In addition, the insert may be further configured to receive additional components (e.g., a flash hider or suppressor) to enhance firearm performance. Numerous other gas operating system configurations will be apparent in light of the present disclosure.

Example Firearm Application

Figure 1B:
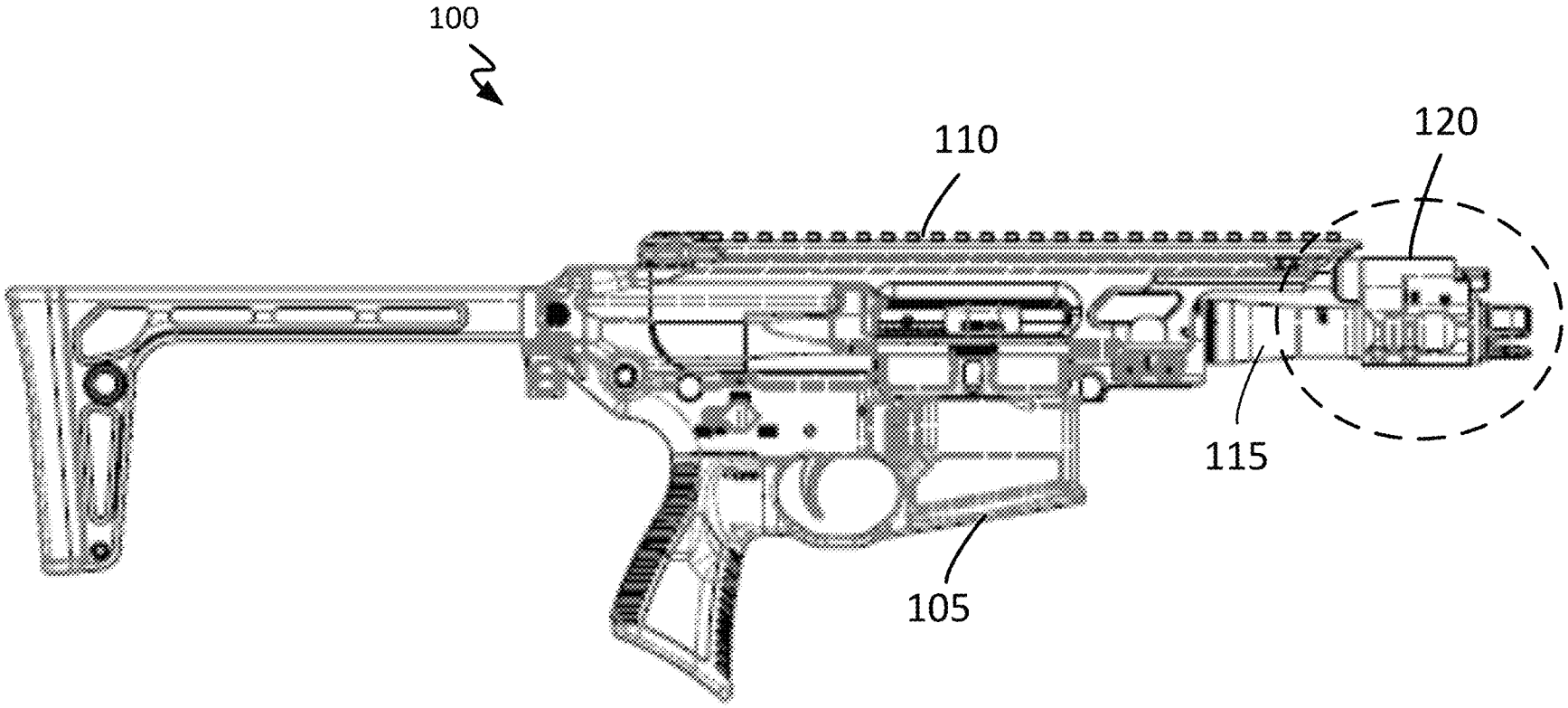
FIG. 1B is a side view of a firearm shown in FIG. 1A with a handguard removed to expose a gas operating system, in accordance with an embodiment of the present disclosure.

FIG. 1A is a side view of a firearm 100 including a gas operating system 120 configured in accordance with an embodiment of the present disclosure. FIG. 1B is a side view of the firearm shown in FIG. 1A with the handguard 112 removed. In one example, the firearm 100 is an automatic rifle, such as a short-barreled automatic rifle. The firearm 100, in some examples, is configured to fire rifle cartridges, such as 5.56 NATO rifle ammunition. As can be seen, in this one example, the firearm 100 includes a lower receiver 105 and an upper receiver 110. The lower receiver 105 assembles to the upper receiver 110 and may include other rifle components, such as components of the fire control group. Other components of the firearm 100, such as a handguard 112, a barrel 115 and a gas operating system 120, are assembled on the upper receiver 110. During the firing cycle, the projectile is propelled through the barrel 115 by combustion gases generated therein. As the projectile passes through the barrel 115, some of the combustion gases are diverted from the barrel 115 to operate the gas operating system 120, which cycles the firearm 100 action for the next firing cycle, as will be described further below.

Example Gas Operating System Configuration

Figure 2:
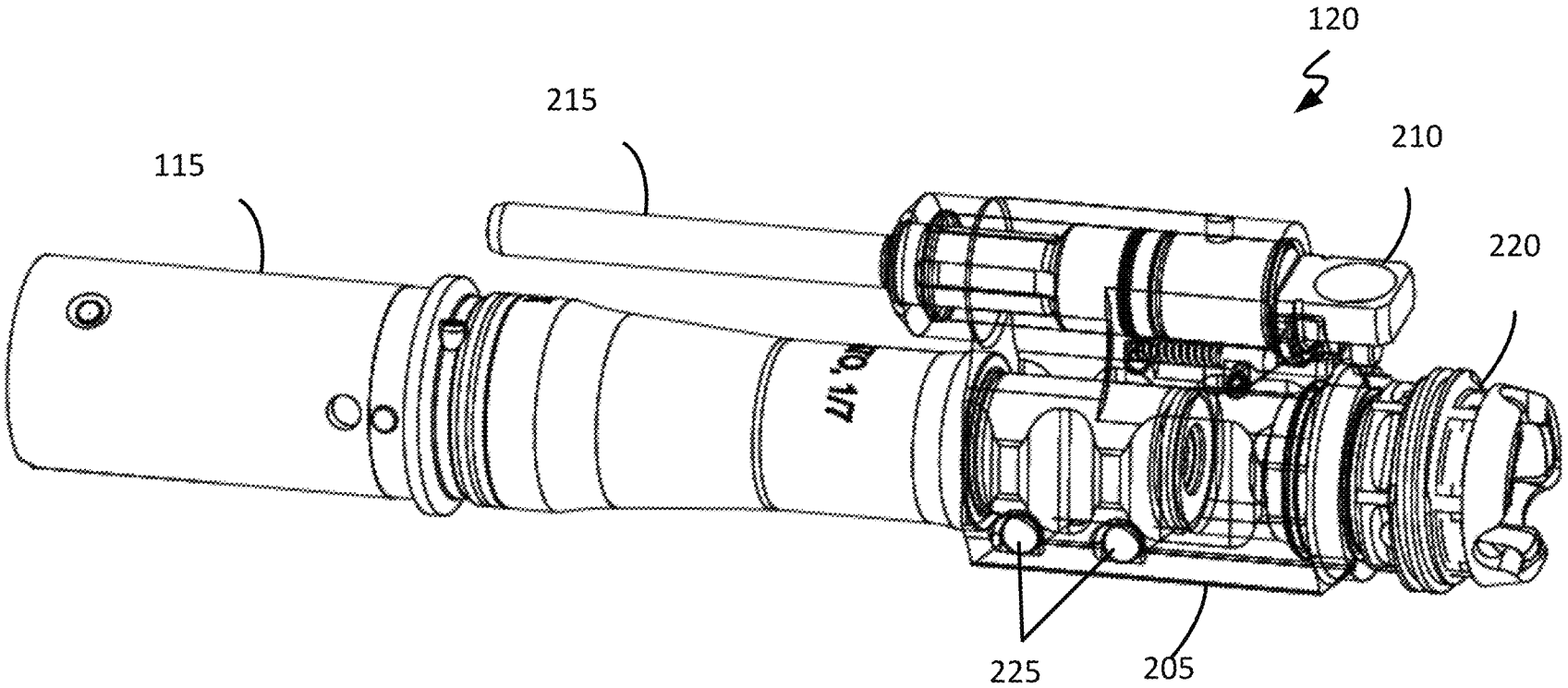
FIG. 2 is a perspective view of an operating system, in accordance with an embodiment of the present disclosure.

FIG. 2 is a perspective view of a gas operating system 120, in accordance with an embodiment of the present disclosure. In this example, the gas operating system 120 is disposed on a distal end of the barrel 115 and secured with pins 225. As can be seen, the system 120 includes a gas block 205, a valve 210, a piston 215, and an insert 220, each of which is described further herein. In general, the valve 210 within the gas block 205 receives some combustion gases as the projectile exits the rifled portion of the barrel 115 and directs the combustion gases to the piston 215. In turn, the combustion gases impinge upon the piston 215 causing it to move. As the piston 215 moves in response to pressurized gases entering the valve (e.g., rearward), it contacts a bolt carrier to cycle the firearm 100, eject the spent cartridge, and load another cartridge into the barrel 115.

Figure 3A:
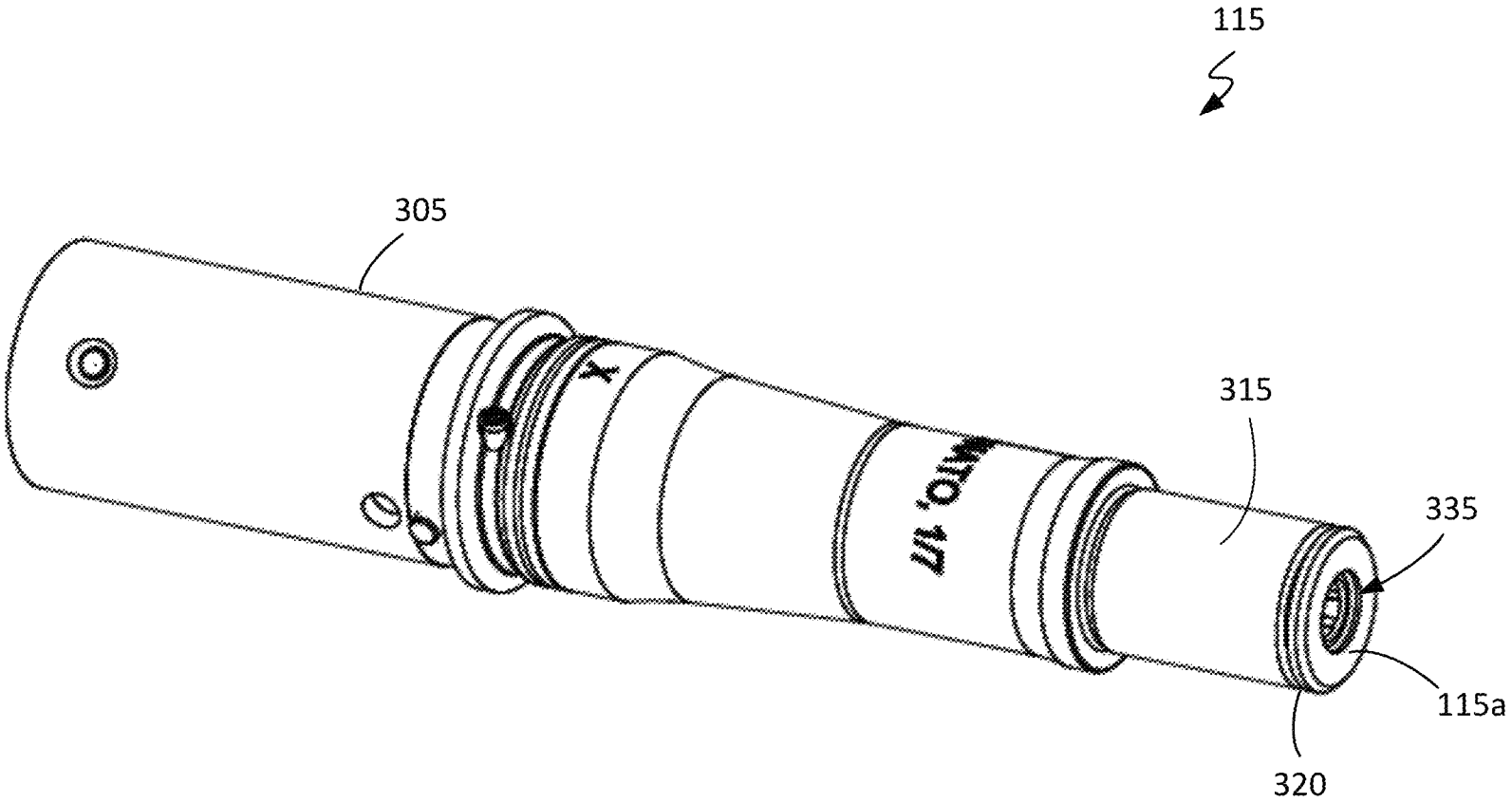
FIG. 3A is a perspective view of a barrel of the firearm, in accordance with an embodiment of the present disclosure.
Figure 3B:
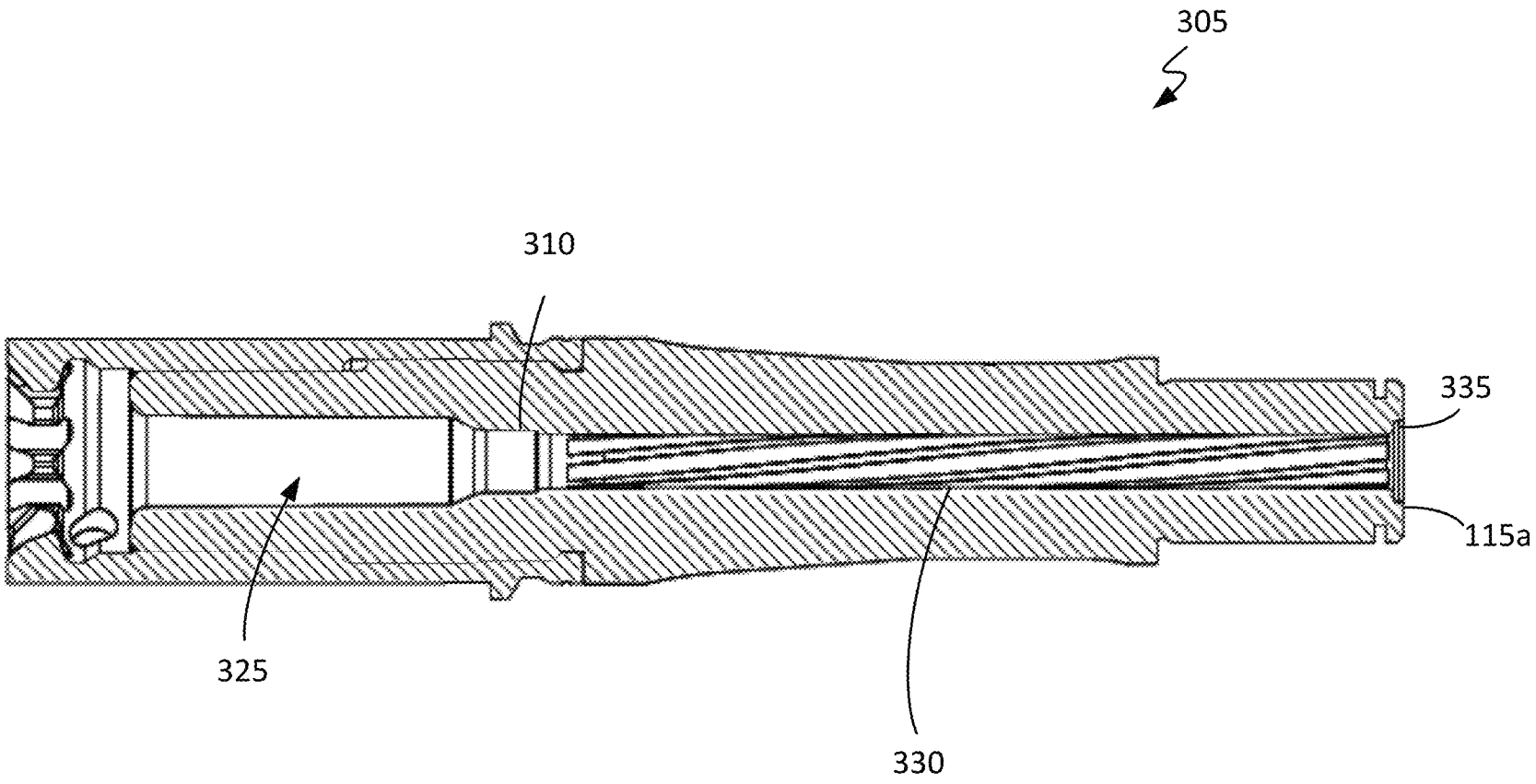
FIG. 3B is a cross-sectional view of the barrel shown in FIG. 3A, in accordance with an embodiment of the present disclosure.

FIG. 3A is a perspective view of a barrel 115 of the firearm 100, in accordance with an embodiment of the present disclosure. FIG. 3B is a cross-sectional view of the barrel 115 shown in FIG. 3A. In this example, the barrel 115 is a short-rifle barrel having a length of 5 inches. In other examples, the barrel 115 can have a length that ranges from less than 5 inches to greater than or equal to 9 inches, depending on a given application. For example, the barrel can have a length of 3.5, 4, 4.5, 5, 5.5, 6, 7, 8, or 9 inches.

As can be seen, the barrel 115, in some examples, includes a barrel body 305, a bore 310, a gas block attachment surface 315, and a groove 320. The barrel body 305 has a tubular shape made from high-strength materials, such as alloy-steel. Within the body 305 is a bore 310 through which the projectile travels. As can be seen, the bore 310 includes a chamber 325 configured to receive the cartridge at the proximal end portion of the barrel 115. Adjacent to the chamber 325 is a rifled portion 330 through which the projectile moves before it exits the barrel 115 at bore opening 335. On the exterior of the barrel body 305 is a gas block attachment surface 315 configured to receive a portion of the gas block 205 (e.g., a cylinder 415, as described further below). In some examples, the surface 315 can be a smooth cylindrical surface having a reduced diameter as compared with other portions of the barrel 115. The surface 315, in some examples, further includes the groove 320 configured to receive a seal (e.g., an O-ring) to prevent combustion gases from exiting the gas operating system 120 through the joint between the barrel 115 and the gas block 205.

Figure 4A:
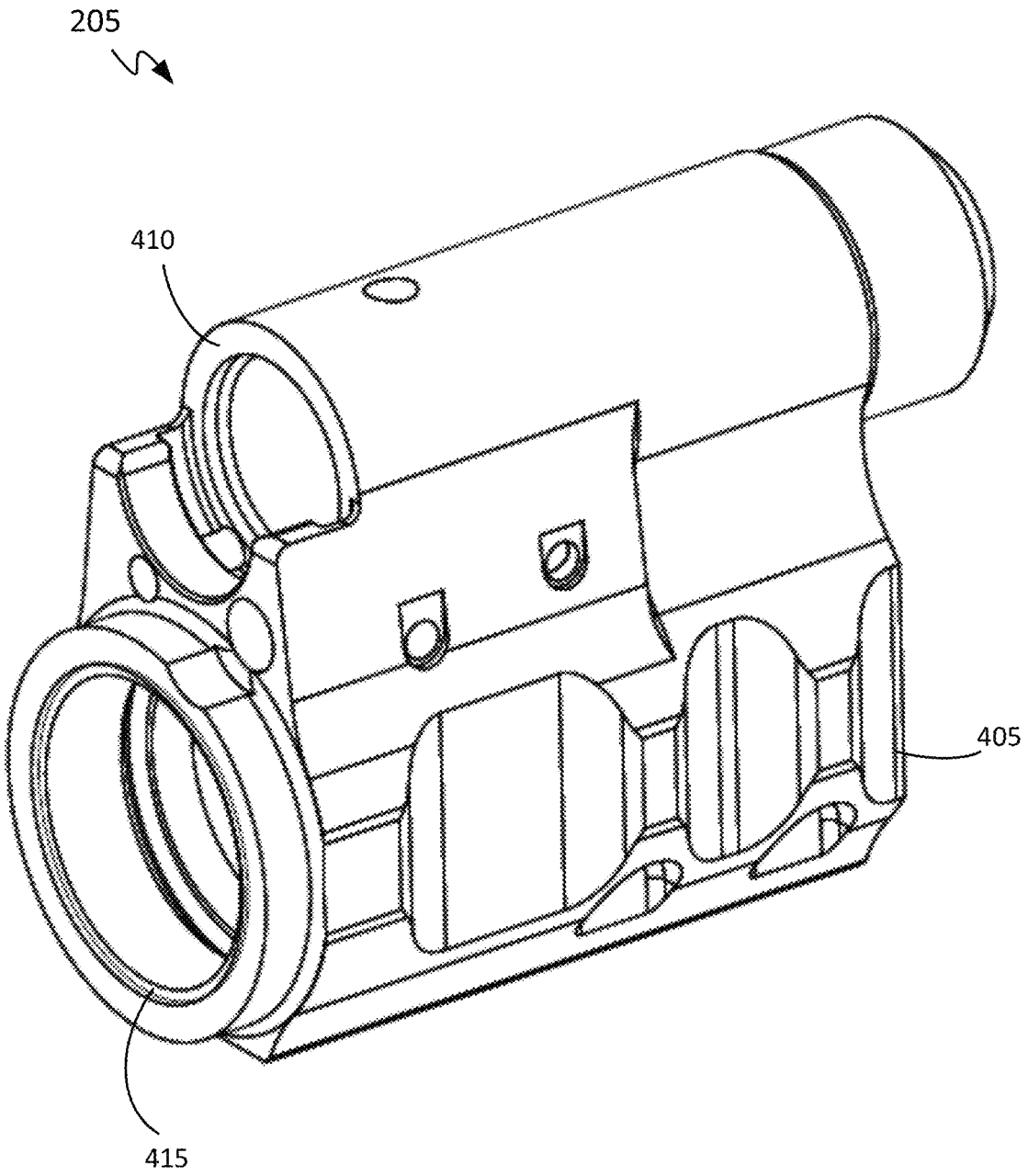
FIG. 4A is a perspective view of a gas block of a gas operating system, in accordance with an embodiment of the present disclosure.
Figure 4B:
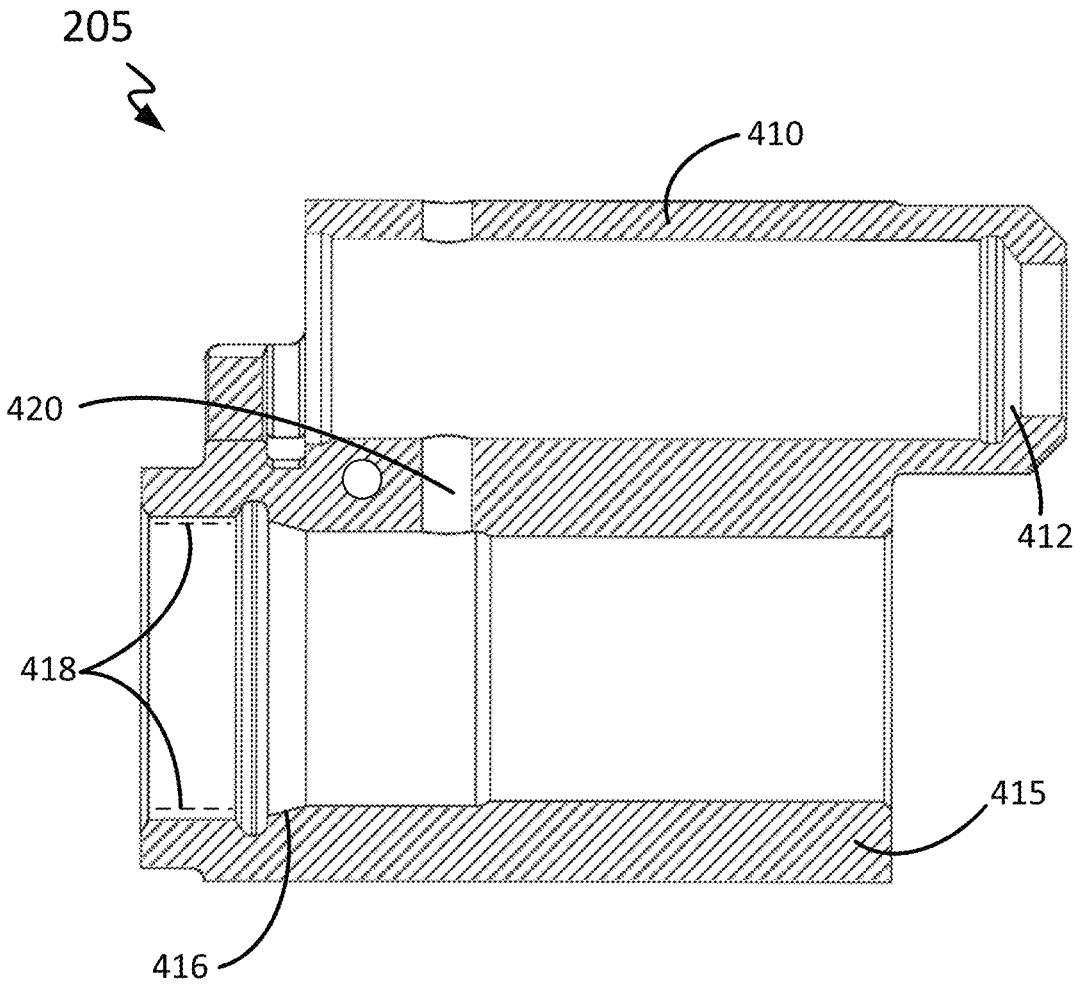
FIG. 4B is a cross-sectional view of the gas block shown in FIG. 4A, in accordance with an embodiment of the present disclosure.

FIG. 4A is a perspective view of a gas block 205 of the gas operating system 120, in accordance with an embodiment of the present disclosure. FIG. 4B is a cross-sectional view of the gas block 205 shown in FIG. 4A. In general, the gas block 205 is configured to receive combustion gases from the barrel 115 and guide or otherwise direct some of those gases to operate a piston disposed therein (e.g., piston 215). The gas block 205 provides a fluid flow path for combustion gases to cycle the firearm 100 and automatically ready the firearm 100 for another firing cycle. In this illustrated example, the gas block 205 includes a gas block body 405 defining an upper cylinder 410 and a lower cylinder 415 therethrough, and a gas block port 420. In a general sense, the body 405 is a housing or structure that interfaces with the firearm 100 (e.g., attaches to the barrel 115) and supports components of the system 120 (e.g., the piston 215). The body 405 can be made from high-strength materials, such as 17-4 PH stainless steel, to withstand the forces applied to the body 405 by the combustion gases present therein during the firing cycle. As can be seen, the body 405 includes the upper cylinder 410 in which to receive components of the gas operating system 120, such as the valve 210 and the piston 215. In some examples, the upper cylinder 410 includes a piston stop surface 412 that limits movement of the piston 215 at one end of its travel. In some examples, upper cylinder 410 need not include the valve 210 and the piston 215. Rather, the gas operating system 120 can be configured as a direct impingement system. In such instances, gases from the cylinder 410 (e.g., via a port in the cylinder and gas tube connected thereto) contact or otherwise impinge upon components of a bolt carrier mechanism to reload the firearm.

Below the upper cylinder 410 is the lower cylinder 415 configured to receive the distal end portion of the barrel 115. In some examples, the lower cylinder 415 is further configured to receive the insert 220 at an opposing end. In some such configurations, the lower cylinder 415 includes a plurality of internal threads 418 (e.g., 13/16-UNEF threads) to secure the insert 220 to the gas block 205. The lower cylinder 415 may also further include a tapered sealing surface 416, to form a seal with a corresponding surface on the insert. The resulting seal prevents gases from exiting through the joint between the gas block 205 and the insert 220 when the insert 220 is installed thereon. As can be seen, the upper cylinder 410 can be aligned with the lower cylinder 415, such that the cylinders 410 and 415 are directly above each other. In some other examples, one of the cylinders 410 or 415 can be offset from (e.g., at an angle of 45 degrees) or otherwise next to (e.g., side-by-side) the other, depending on a given application.

The lower cylinder 415, in some examples, is further configured to position the insert 220 and the barrel 115 at a distance from one another so as to define a gas expansion chamber (e.g., gas expansion chamber 605 shown in FIG. 6) that reduces pressure, temperature, and/or velocity of the combustion gases passing therethrough, as will be described further herein. In addition, the lower cylinder 415 may further include one or more raised features (e.g., bumps, steps, etc.) or recessed features (e.g., grooves, channels, dimples, recesses, etc.) or a combination thereof, that assist with generating one or more regions of lower pressure, temperature, and/or velocity of combustion gas within the gas expansion chamber.

Disposed between the upper cylinder 410 and the lower cylinder 415 is a gas block port 420. The gas block port 420, in general, is configured to receive combustion gases from the barrel 115 and re-direct those gases to the valve 210 disposed within the upper cylinder 410 to operate the gas operating system 120. In this example, the gas block port 420 is a vertical internal bore that extends from the lower cylinder 415 to the upper cylinder 410. In other examples, the gas block port 420 may be positioned at an angle relative to one of the cylinders 410 and 415. The gas block port 420, in some examples, includes a diameter of 0.125 inches. Numerous other gas block embodiments will be apparent in light of the present disclosure.

Figure 5A:
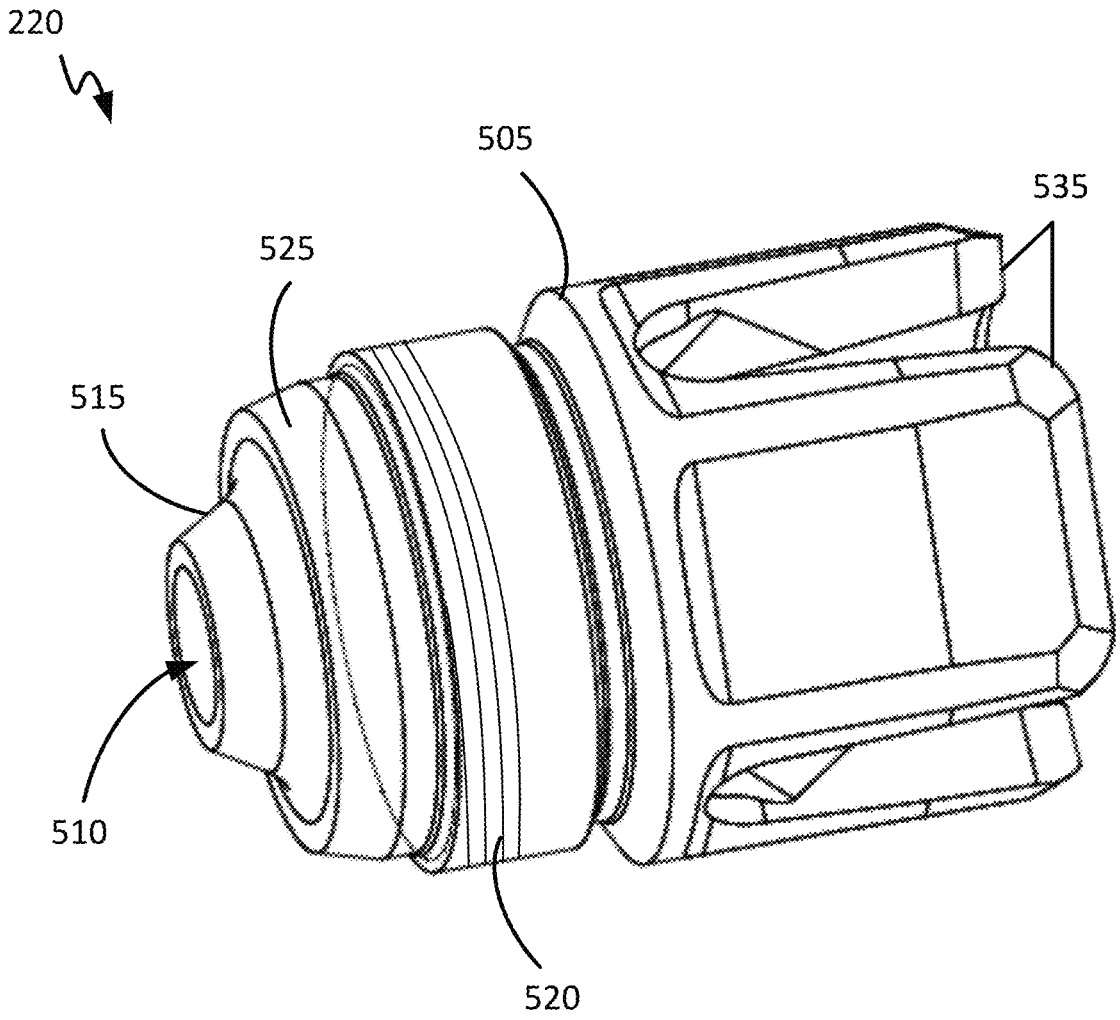
FIG. 5A is a perspective view of an insert of a gas operating system, in accordance with an embodiment of the present disclosure.
Figure 5B:
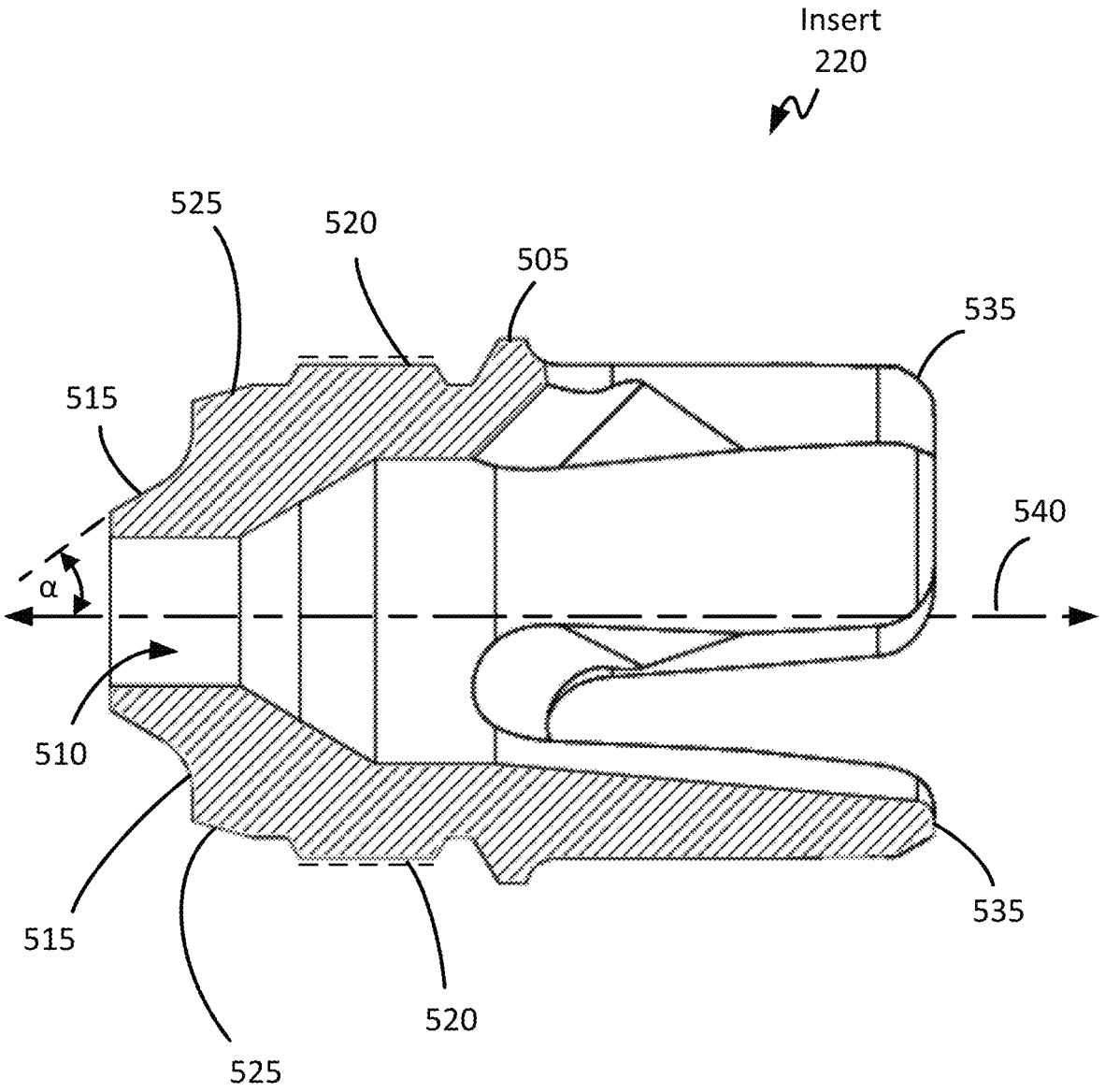
FIG. 5B is a cross-sectional view of the insert shown in FIG. 5A, in accordance with an embodiment of the present disclosure.

FIG. 5A is a perspective view of an insert 220 of the gas operating system 120, in accordance with an embodiment of the present disclosure. FIG. 5B is a cross-sectional view of the insert 220 shown in FIG. 5A. Generally speaking, the insert 220 can improve gas flow to help stabilize the projectile as it exits the barrel 115, in accordance with some embodiments. In addition, the insert 220 can include one or more external surfaces that re-direct the flow of the combustion gases within a chamber to reduce the pressure, temperature, and/or velocity of the gases therein. In some examples, the insert 220 can be further configured to modify or otherwise reduce the appearance of flash as the projectile and/or burning propellant exit the barrel 115. In yet other examples, the insert is further configured to receive additional firearm components, such as a flash hider or suppressor. As can be seen, in this example, the insert 220 includes an insert body 505, an internal bore 510, and control surfaces 515. The body 505 can be a unitary component, in which features (e.g., external threads 520 and flash suppressant features 535) and surfaces (e.g., control surfaces 515 and tapered sealing surfaces 525) are disposed thereon. As can be seen, the body 505 defines the internal bore 510 that receives the projectile from the barrel 115 and allows the projectile to exit the firearm 100. In some examples, the bore 510 can have a diameter of 0.245 inches. In other examples, the bore 510 can include a diameter within the range of less than 0.240 to greater than or equal to 0.260 inches. Numerous variations and embodiments are acceptable, as will be appreciated.

The insert 220 further includes one or more control surfaces 515. In general, the control surfaces 515 guide or otherwise re-direct flow of combustion gases exiting the barrel 115 and impinging on the control surfaces 515. Control surfaces 515 function to provide one or more regions of lower pressure, temperature, and/or velocity of combustion gas within the gas expansion chamber defined between the barrel 115 and the insert 220. The control surfaces 515 can be a single surface or a combination of multiple surfaces on the proximal end of the insert 220. The combination of surfaces may include one or more radiuses to allow different surfaces to transition smoothly from one surface to another. In some examples, the control surfaces 515 include tapered surfaces that are positioned at an angle ($\alpha$) relative to a bore axis 540. In this one example, the control surfaces 515 include a straight tapered portion having a 30-degree angle relative to axis 540. In other examples, tapered portions of the control surfaces 515 can be located at 10, 15, 20, 35, 45, 50, 60, 75, and 85-degree angle relative to the longitudinal axis 540. In addition, the control surfaces 515 can include a uniform diameter or a varying diameter, depending on a given application. The control surfaces 515, moreover, can include, in some examples, one or more raised features (e.g., bumps, steps, etc.) or recessed features (e.g., grooves, dimples, recesses, etc.) or a combination thereof, that promote favorable fluid dynamics. The control surfaces 515, in some examples, can be configured and arranged such that upon installation of the insert 220 within the gas block 205, the control surfaces 515 extend or otherwise project into a gas expansion chamber of the firearm (e.g., gas expansion chamber 605) to prevent high-pressure combustion gases within the gas expansion chamber from enveloping or otherwise surrounding the projectile as it moves through the gas expansion chamber.

The insert body 505, in some examples, further includes external threads 520 (e.g., 13/16-UNEF threads) to attach the insert 220 in the lower cylinder 415 of the gas block 205. Adjacent to external threads 520 is tapered sealing surface 525 configured to form a seal with the gas block 205. The body 505, in this one example, further includes a plurality of flash suppressant features 535 configured to reduce the appearance of muzzle flash (e.g., visible light) from the firearm 100. As can be seen, the suppressant features 535 are disposed on the distal end of the insert 220. In this one example, the insert 220 includes at least three flash suppressant features 535 that are evenly distributed about the bore axis 540. Numerous other configurations of insert 220 will be apparent in light of the present disclosure.

Figure 6:
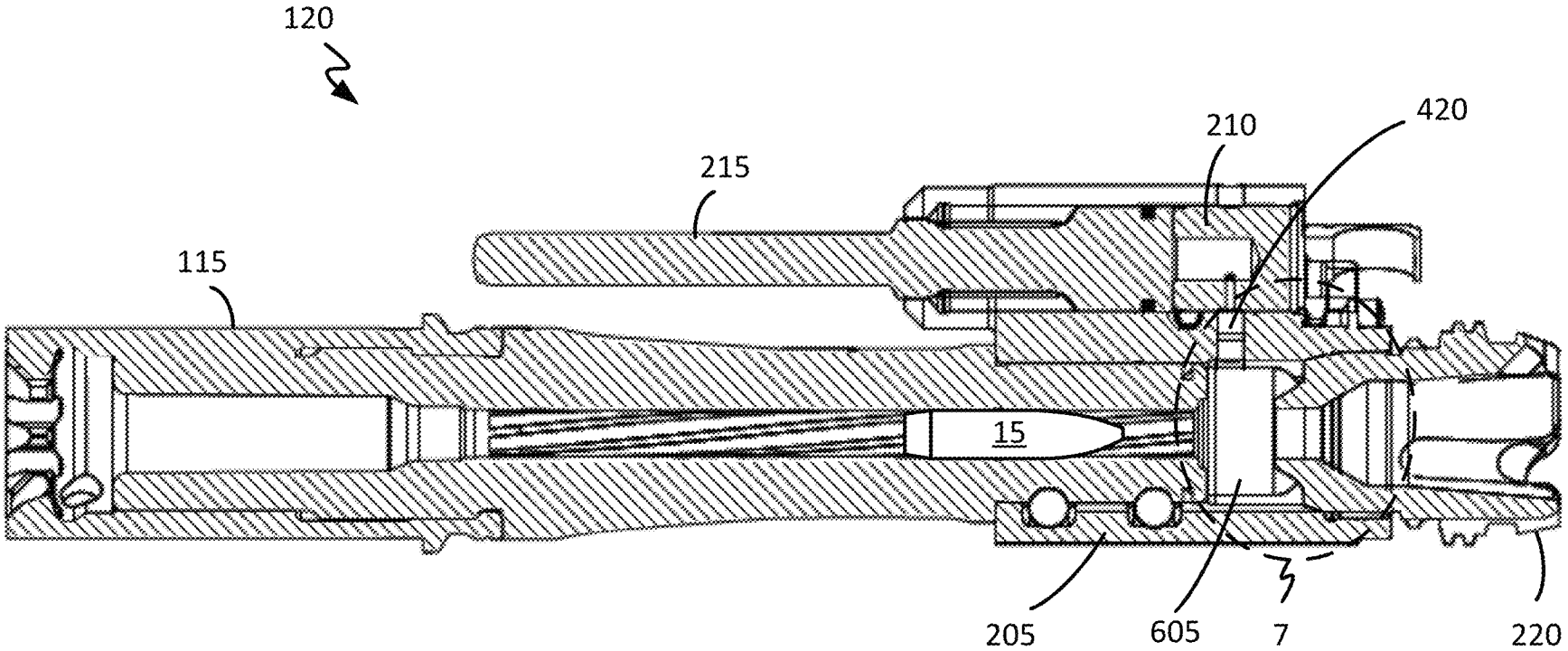
FIG. 6 is a cross-sectional view of a gas operating system, in accordance with an embodiment of the present disclosure.
Figure 7:
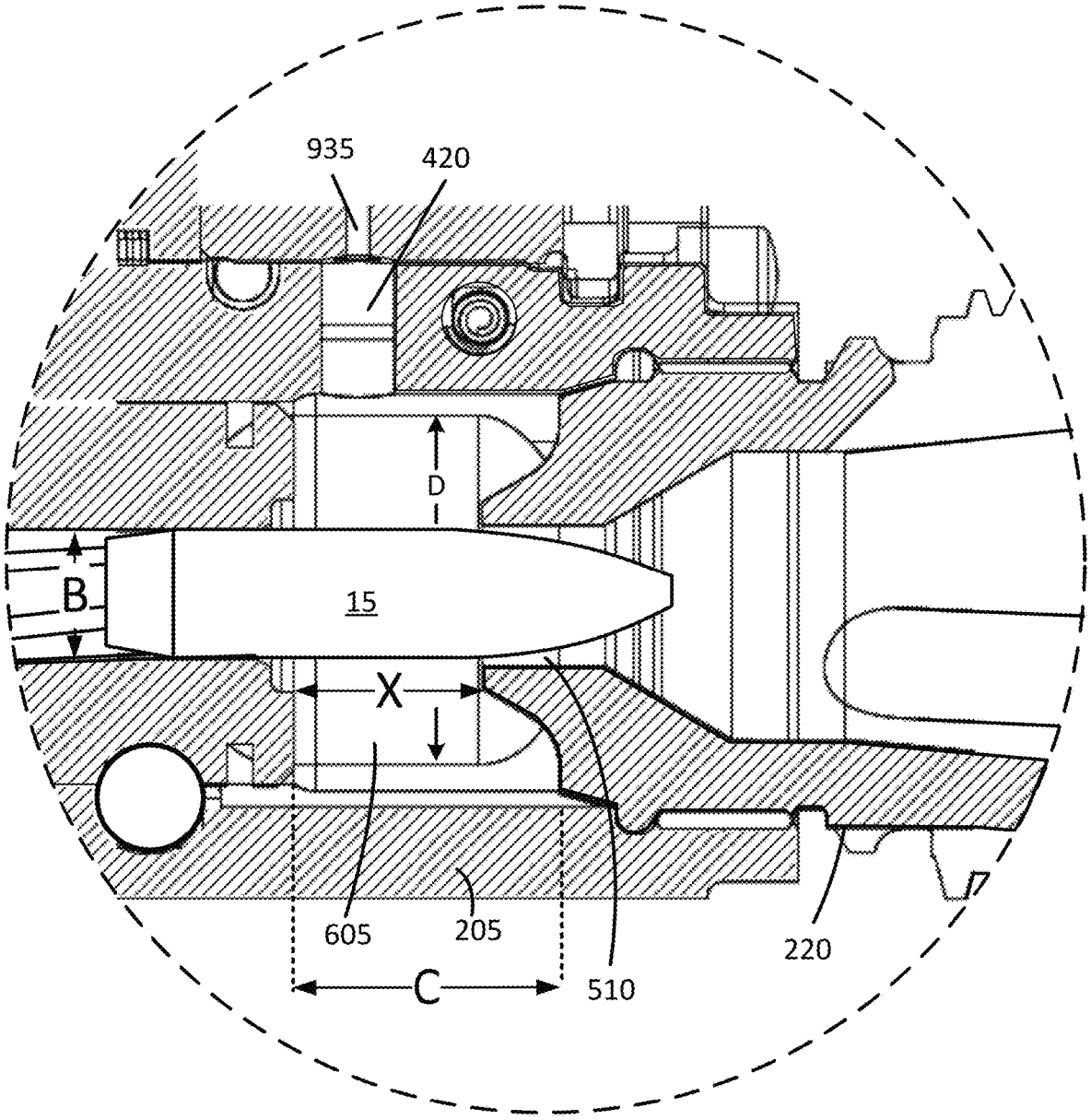
FIG. 7 is an enlarged view of a gas expansion chamber of the gas operating system shown in FIG. 6, in accordance with an embodiment of the present disclosure.

FIG. 6 is a cross-sectional view of the gas operating system 120, in accordance with an embodiment of the present disclosure. FIG. 7 is an enlarged view of the gas expansion chamber 605 of the gas operating system 120 shown in FIG. 6. As can be seen, in this one example, the gas operating system 120 includes a gas expansion chamber 605. Generally speaking, the gas expansion chamber 605 allows combustion gases that propel the projectile 15 through the barrel 115 to expand, and thereby generate one or more regions of reduced pressure, velocity, and/or gas temperature. Some of the gases within these regions are diverted or otherwise supplied to the valve 210 of the gas operating system 120 via the gas block port 420 within the gas block 205. This may be particularly noteworthy, because reduced pressure, temperature, and/or velocity of combustion gases cause less erosion of the gas block port 420 over time, thereby increases the service life and/or accuracy of the firearm.

The gas expansion chamber 605 can include geometry that promotes movement of combustion gases therein. For instance, as shown in FIG. 7, the diameter "D" of the gas expansion chamber 605 can be longer than an axial length "C" of the gas expansion chamber 605. In this example, the axial length "C" is the distance from the distal end of the barrel 115 to the location at which the insert 220 contacts the inside of lower cylinder of the gas block 205 to define one end of the gas expansion chamber 605. In other embodiments, the axial length "C" of the gas expansion chamber 605 can be greater than the diameter "D", depending on a given application. In some embodiments, the gas expansion chamber 605 can defined by a combination of surfaces, such as an inside diameter of the lower cylinder 415 of the gas block 205, one or more control surfaces 515 of the insert 220, and the distal face of the barrel 115. In some cases, the gas expansion chamber 605 can have a cross-sectional shape (as viewed from the side as in FIG. 7) of a cylinder, a polygon, a sphere, and a cone (or a combination thereof). In some such cases, the cross-sectional shape of the gas expansion chamber 605 may further include a frustum feature (e.g., surface perpendicular to the bore axis) at one or both ends of the chamber 605. In addition, the gas expansion chamber 605 may include one or more tapered, angled, or otherwise curved surfaces that promote flow of combustion gases within the gas expansion chamber 605 to assist with projectile travel and/or to operate a gas operating system. Furthermore, the gas expansion chamber 605 may also include one or more radiuses at the interface between two or more components disposed therein to further promote the flow of combustion gases within the gas expansion chamber 605. The cross-sectional shape can be consistent or can vary along the axial length of the chamber. In some cases, the shape and volume of the chamber is defined by the gas block 205 and insert 220.

The size of the gas expansion chamber 605, in some examples, can be based at least in part on the diameter of the bore 310 of the barrel 115 relative to the inner diameter of the lower cylinder 415 of the gas block 205. For instance, as can be seen in FIG. 7, the gas expansion chamber 605 is located immediately adjacent the distal end of the barrel within a portion of the lower cylinder 415 of the gas block 205 having a diameter "D". The diameter "D", as shown, can be from 0.675 inches to 0.697 inches, depending on a given application. In other cases, the diameter "D" has a size in the range of 0.500 inches to 0.750 inches, depending on the application. The diameter "D", in some cases, can be twice the size of a bore of diameter "B" of the barrel 115. For instance, for a bore diameter "B" ranging in size between 0.225 inches to 0.275 inches, the diameter "D" can be between 0.450 inches and 0.550 inches, in accordance with some embodiments.

Furthermore, the volume of the gas expansion chamber 605, in some examples, can be at least partially defined by the position of the insert 220 relative to the distal end of the barrel 115. In more detail, depending on the position of the insert 220 relative to the distal end of the barrel 115, the volume of the gas expansion chamber 605 may increase or decrease, thereby affecting the level of reduction in pressure, temperature, and/or velocity of combustion gas therein. As can be seen, the insert 220 can be a distance "X" from the end of the barrel 115. In one example, distance "X" can be from less than 0.375 inches to 0.500 inches or greater. In such examples, the gas expansion chamber 605 can have a volume of approximately 0.140 to 0.185 cubic inches or more, depending on a given application. The gas expansion chamber 605, in some examples, can have an axial length "C" in a range from 0.200 inches to 0.300 inches, depending on the position of the insert 220 relative to the barrel 115. A gas expansion chamber 605 with an axial length "C" less than 0.2 inches or greater than 0.3 inches is acceptable in some embodiments. In some embodiments, the gas expansion chamber 605, has a diameter "D" that is at least one and a half, two, three, or four times the diameter "B" of the bore 310 of the barrel 115.

In addition, the location of the insert 220 relative to the barrel 115 can also affect the accuracy of the projectile 15 fired from the firearm 100. For instance, in one example, an opening of the internal bore 510 of the insert 220 can be positioned an axial distance "X" from the barrel 115. Distance "X", in some examples, is sized such that part of the projectile 15 enters the bore 510 of the insert 220 before the projectile 15 fully exits the bore of the barrel 115. Stated differently, the axial length X of the gas expansion chamber 605 is less than the axial length of the projectile 15, in accordance with some embodiments. For example, projectiles of some 5.56×45 mm ammunition have an axial length from 0.750 to 0.940 inch. Thus, the projectile 15 bridges the gap (of axial length "X") between the insert 220 and the distal end 115*a* of the barrel 115. This can be particularly noteworthy because the insert 220 can enable movement of the projectile 15, so that the projectile maintains its current trajectory as the projectile 15 passes through the gas expansion chamber 605. In particular, the axial position of the insert 220 relative to the barrel 115 can prevent combustion gases from laterally affecting the flight of the projectile 15. Otherwise, such forces can cause the projectile 15 to move off its intend path, and thereby reduce the accuracy of the firearm 100. Thus, in some examples, the manner in which the insert 220 is attached to the gas block 205 can prevent the combustion gases within the gas expansion chamber 605 from surrounding or otherwise engulfing the projectile 15 as the projectile 15 moves through the gas expansion chamber 605.

The gas expansion chamber 605 is also in fluid communication with the gas block port 420 of the gas block 205. Specifically, the gas block port 520 extends between the gas expansion chamber 605 and the gas valve opening 935, in accordance with some embodiments. Accordingly, the gas block port 420 is in direct communication with the gas expansion chamber 605. As shown in FIG. 7, for example, the gas block port 420 can be located adjacent to the proximal end of the gas expansion chamber 605, which is defined by the distal end 115*a* of the barrel 115. In such a configuration, the gas block port 420 can receive expanded combustion gases at a pressure sufficient to operate the gas operating system 120 and without reducing the service life of the firearm. In some other examples, the gas block port 420 can also be in the middle or adjacent the distal end of the gas expansion chamber 605, depending on a given application. Numerous configurations of the gas expansion chamber 605 will be apparent in light of the present disclosure.

Additional Gas Operating System Configurations

Figure 8A:
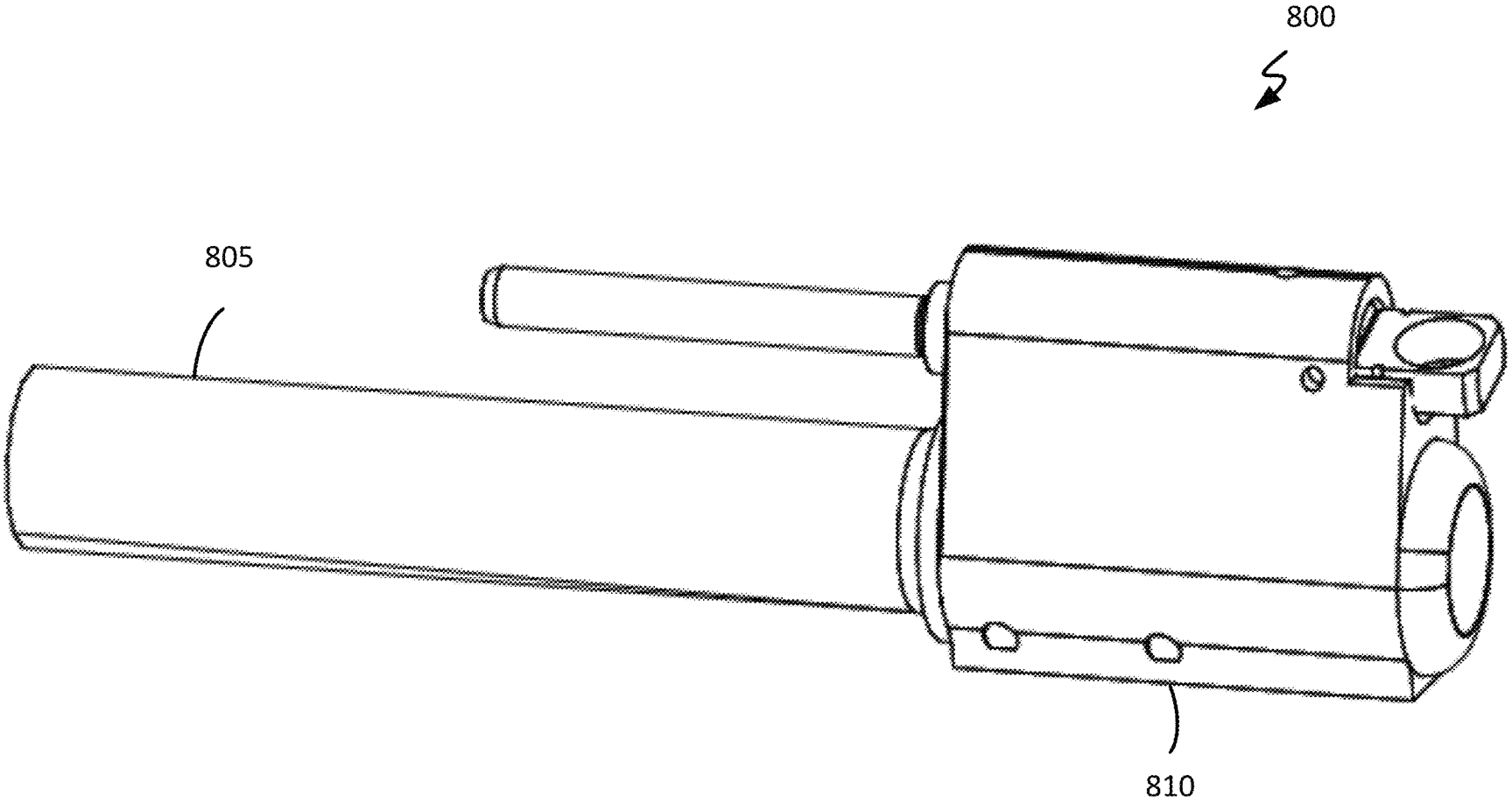
FIG. 8A is a perspective view of a gas operating system for a firearm, in which the insert is within the gas block, in accordance with an embodiment of the present disclosure.
Figure 8B:
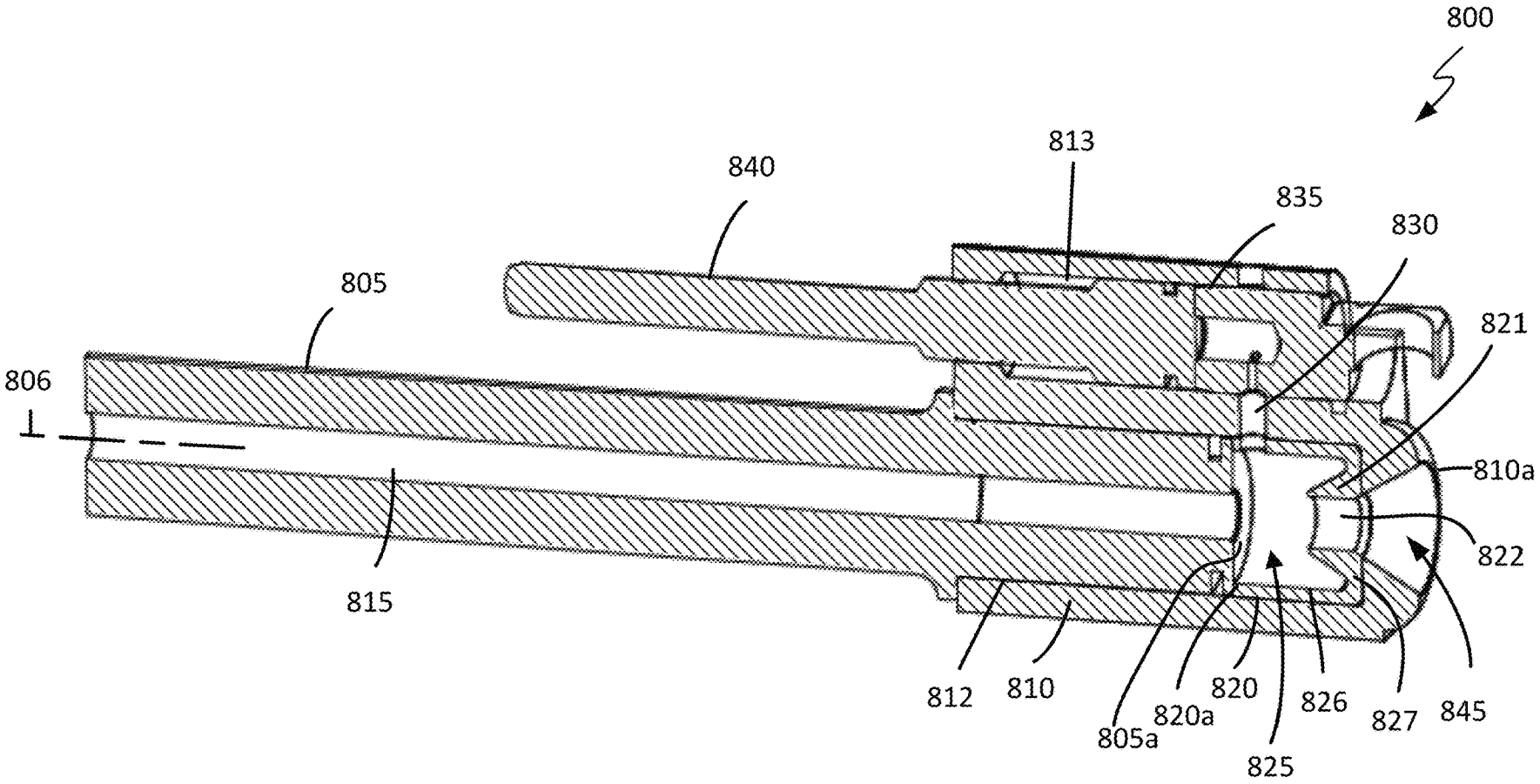
FIG. 8B is a cross-sectional view of the gas operating system shown in FIG. 8A, in accordance with an embodiment of the present disclosure.

FIG. 8A is a perspective view of a gas operating system 800 for a firearm 100, and includes the insert 820 (not visible in FIG. 8A) within the gas block 810, in accordance with another embodiment of the present disclosure. FIG. 8B is a cross-sectional view of the gas operating system 800 shown in FIG. 8A. The gas operating system 800 shown in FIGS. 8A-8B can achieve an overall shorter firearm length without affecting performance and/or service life of the firearm 100, in accordance with an embodiment of the present disclosure. In one example, the operating system 800 includes a barrel 805 attached to a gas block 810 in a similar fashion as described herein in relation to the gas operating system 120. The gas block 810 further includes an insert 820 disposed therein, such that the distal end of the gas block 810 is the distal end of the firearm 100. As shown in FIG. 8B, for example, the insert 820 can be installed within the lower cylinder 812 of the gas block 810. The proximal end 820*a* of the insert 820 can be open, such that the distal end 805*a* of the barrel 805 defines the proximal end of the gas expansion chamber 825. For example, the insert 820 has a cup-like shape with a generally cylindrical insert body 826 that defines gas chamber 825 and extending axially to the proximal end 820*a* of the insert 820. The generally cylindrical body 826 connects to the distal base 827 of the insert that defines pathway 822 distally of the gas expansion chamber 825 and through which the projectile exits the firearm. In some such embodiments, the proximal end 820*a* of the insert 820 abuts the distal end 805*a* of the barrel 805, but this is not required in all embodiments.

In another example, the proximal end 820*a* of the insert 820 can be closed except for an entrance opening (not shown) to allow the projectile to move from the bore 815 to the air chamber 825. In some such embodiments, for example, the insert 820 defines the air chamber 825 as an open region positioned axially between a proximal end portion (e.g., a proximal wall (not shown)) and the insert base 827, where the proximal end may abut the distal end 805*a* of the barrel 805.

As shown in FIG. 8B, for example, the gas port 830 extends from the upper cylinder 813 to the lower cylinder 812 and through the insert 820 (e.g., through insert body 826) so that the air chamber 825 is in fluid communication with the valve 835 to operate the piston 840. The gas block 810 also includes an exit aperture 845, through which the projectile passes through to exit the firearm 100. In some embodiments, the exit aperture 845 can have a frustoconical shape that increases in diameter as it extends axially from the internal pathway 822 to the distal end 810*a* of the gas block 810. Numerous configurations and variations will be apparent in light of the present disclosure.

As shown in FIG. 8B, for example, the insert 820 is housed completely within the lower cylinder 812 of the gas block 810 of the gas operating system 800. Thus, the diameter of the gas expansion chamber 825 is the inner diameter of the insert 820 along the gas expansion chamber 825. Together, the distal end 805 of the barrel 805, the lower cylinder 812 of the gas block 810, and the insert 820 define an air chamber 825 that functions like some embodiments of air chamber 605 discussed above. In the example shown in FIG. 8B, an inside 821 of a distal end portion 827 of the insert 820 defines a bore or pathway 822 through which the projectile travels to exit the gas expansion chamber 825. The inside 821 of the distal end portion 827, in some examples, can be a flat surface perpendicular to the bore axis 806. In such instances, the insert 820 can define the gas expansion chamber 825 having a uniform cross-sectional size and shape and that extends from the distal end 805*a* of the barrel 805 to the face at the inside 821 of the distal end portion 827. In other examples, the inside 821 can extend proximally into the gas expansion chamber 825, such as shown in FIG. 8B. When the inside 821 of the distal end portion 827 extends into the gas expansion chamber 825, it reduces the effective volume of the gas expansion chamber 825. However, such a protrusion axially into the gas expansion chamber 825 enables the projectile to enter the internal pathway 822 of the insert 820 before exiting the bore 815 of the barrel 805, and thus ensuring that the projectile maintains its intended path of travel. In some embodiments, the inside 821 of the distal end portion 827 can include one or more surfaces that are angled, curved, or otherwise inclined to the bore axis 806 and that promote turbulent flow of combustion gases within the gas expansion chamber 825, similar to control surfaces 515 at the proximal end of insert 220 discussed above. In such cases, the gas expansion chamber 825 can have a non-uniform cross-sectional shape.

Figure 9A:
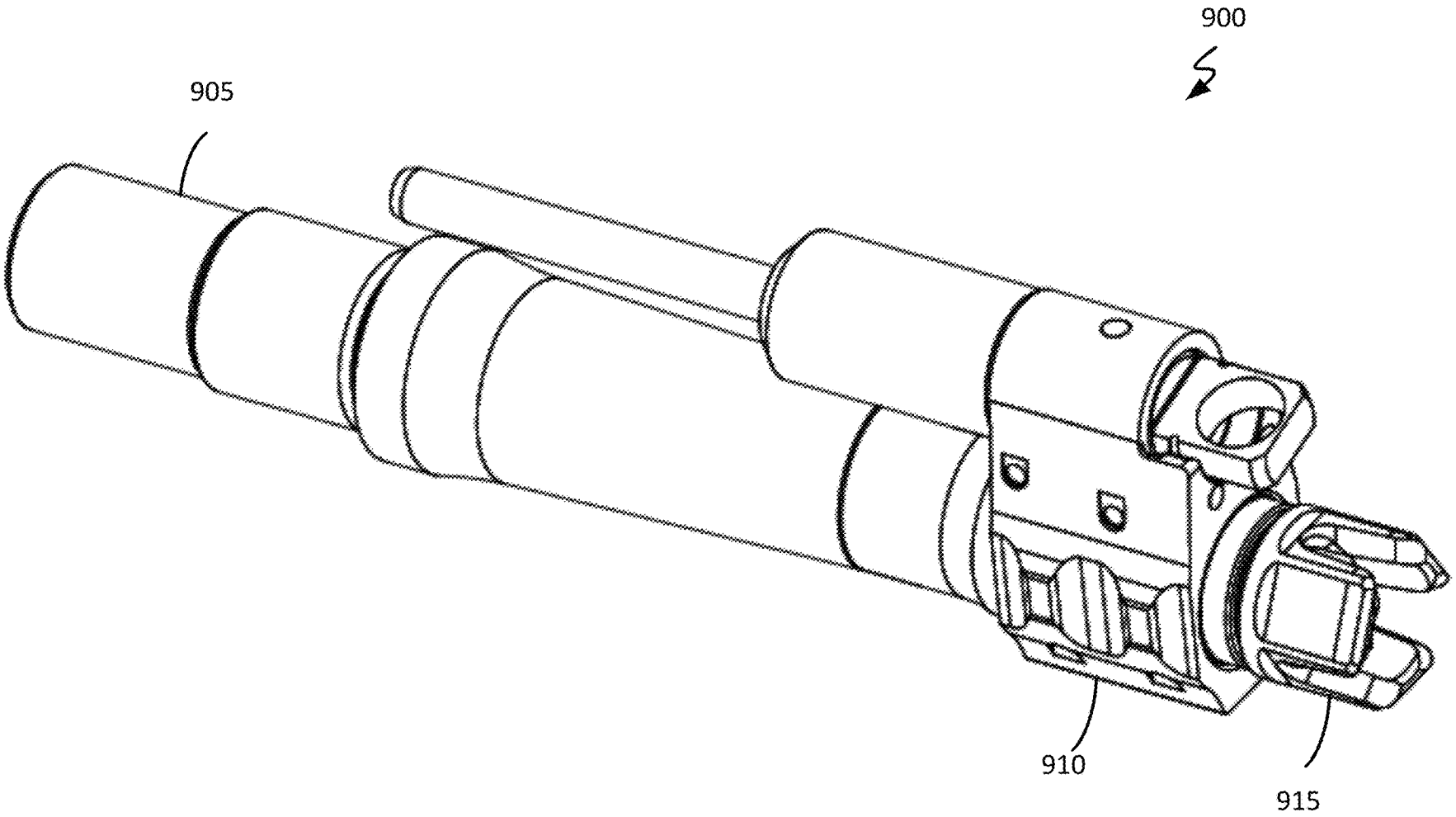
FIG. 9A is a perspective view of a gas operating system for a firearm, in which the air chamber is within the barrel, in accordance with an embodiment of the present disclosure.
Figure 9B:
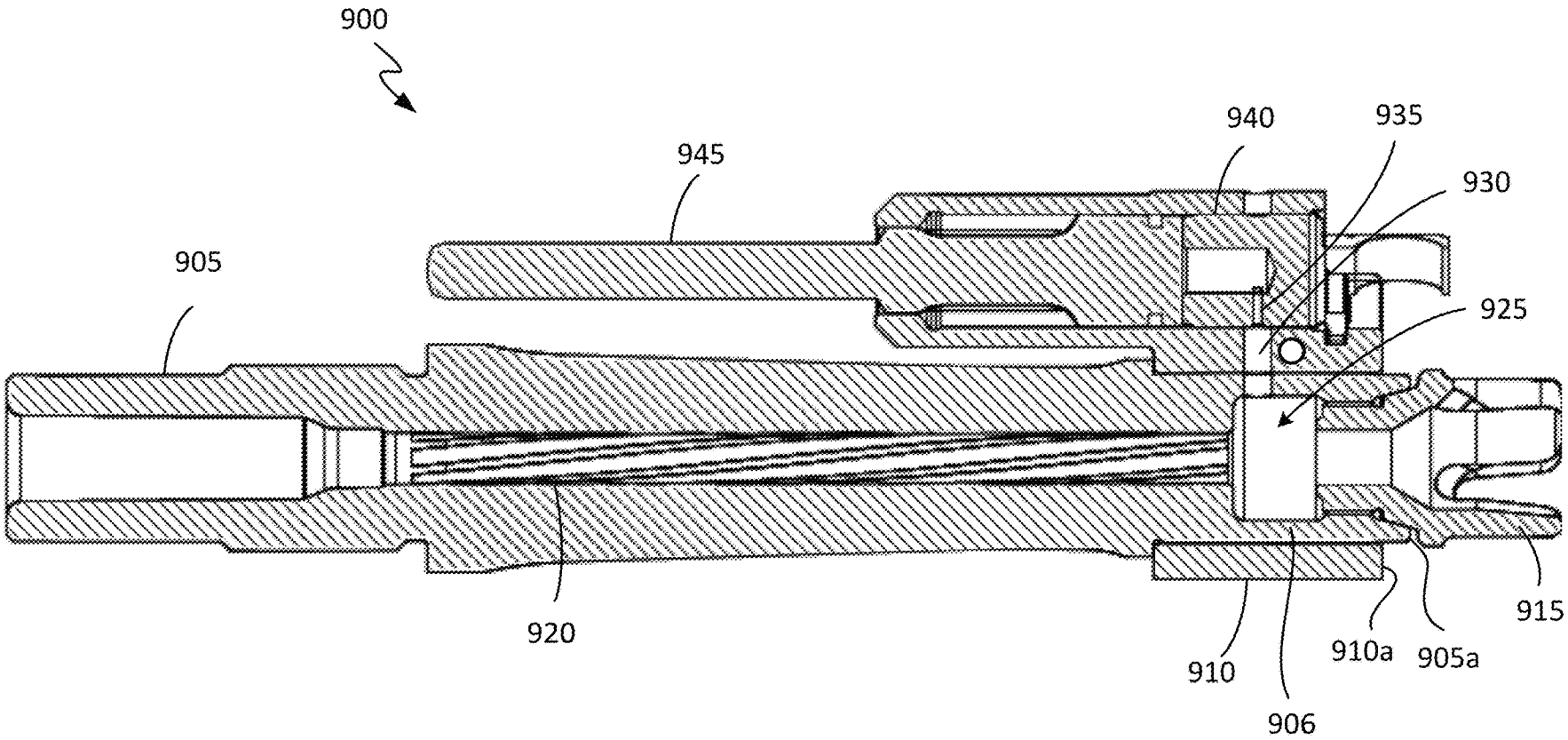
FIG. 9B is a cross-sectional view of the gas operating system shown in FIG. 9A, in accordance with an embodiment of the present disclosure.

FIG. 9A is a perspective view of a gas operating system 900 for a firearm 100, in which the gas expansion chamber 925 is defined in the barrel 905, in accordance with another embodiment of the present disclosure. FIG. 9B is a cross-sectional view of the gas operating system 900 shown in FIG. 9A. In this one example, the gas operating system 900 includes a barrel 905, a gas block 910, and an insert 915. In some embodiments, the barrel 905 extends through and distally beyond the distal end 910*a* of the gas block 910. In some such configurations, the barrel 905 can receive the insert 915 rather than attaching the insert 902 to the gas block 910. Additionally, the gas expansion chamber 925 is defined in the distal end portion 906 of the barrel 905. For example, the gas expansion chamber 925 is defined distally of and adjacent to the rifled bore 920, rather than being defined in the gas block 910. Integrating the gas expansion chamber 925 into the barrel 905 enables the gas block 910 to be positioned concentric with the distal end portion 906 of the barrel 905 rather than adjacent thereto. When configured in this manner, the gas block 910 does not increase the overall length of the firearm 100. In addition, the barrel 905 defines a gas port 930 extending between and fluidly connecting the gas expansion chamber 925 and a valve opening 935 in the gas block 910. Together, the gas port 930 and the valve opening 935 provide fluid communication between the gas expansion chamber 925 and the valve 940 to operate piston 945.

Figure 10A:
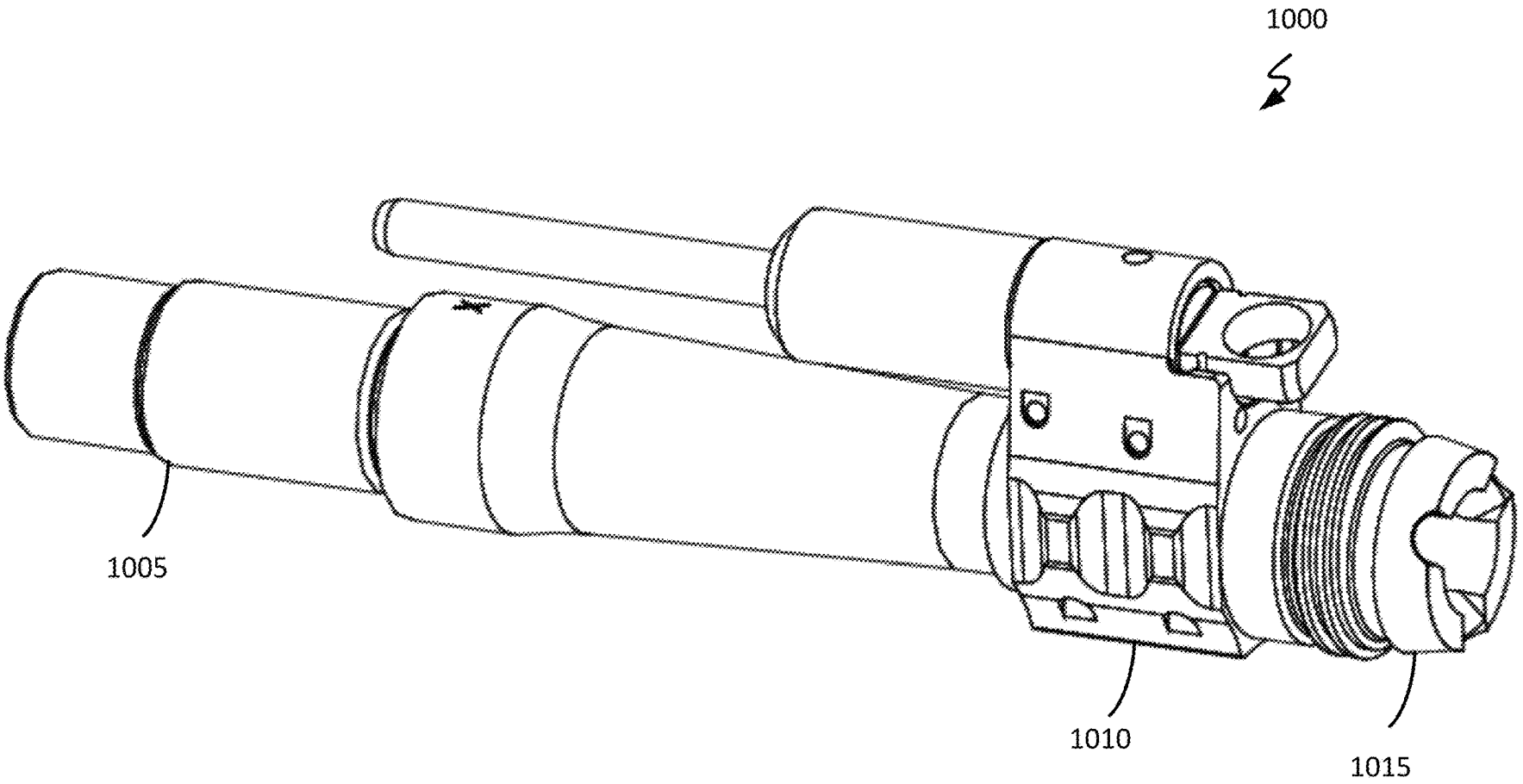
FIG. 10A is a perspective view of a gas operating system for a firearm, in which the insert is external to the barrel, in accordance with another embodiment of the present disclosure.
Figure 10B:
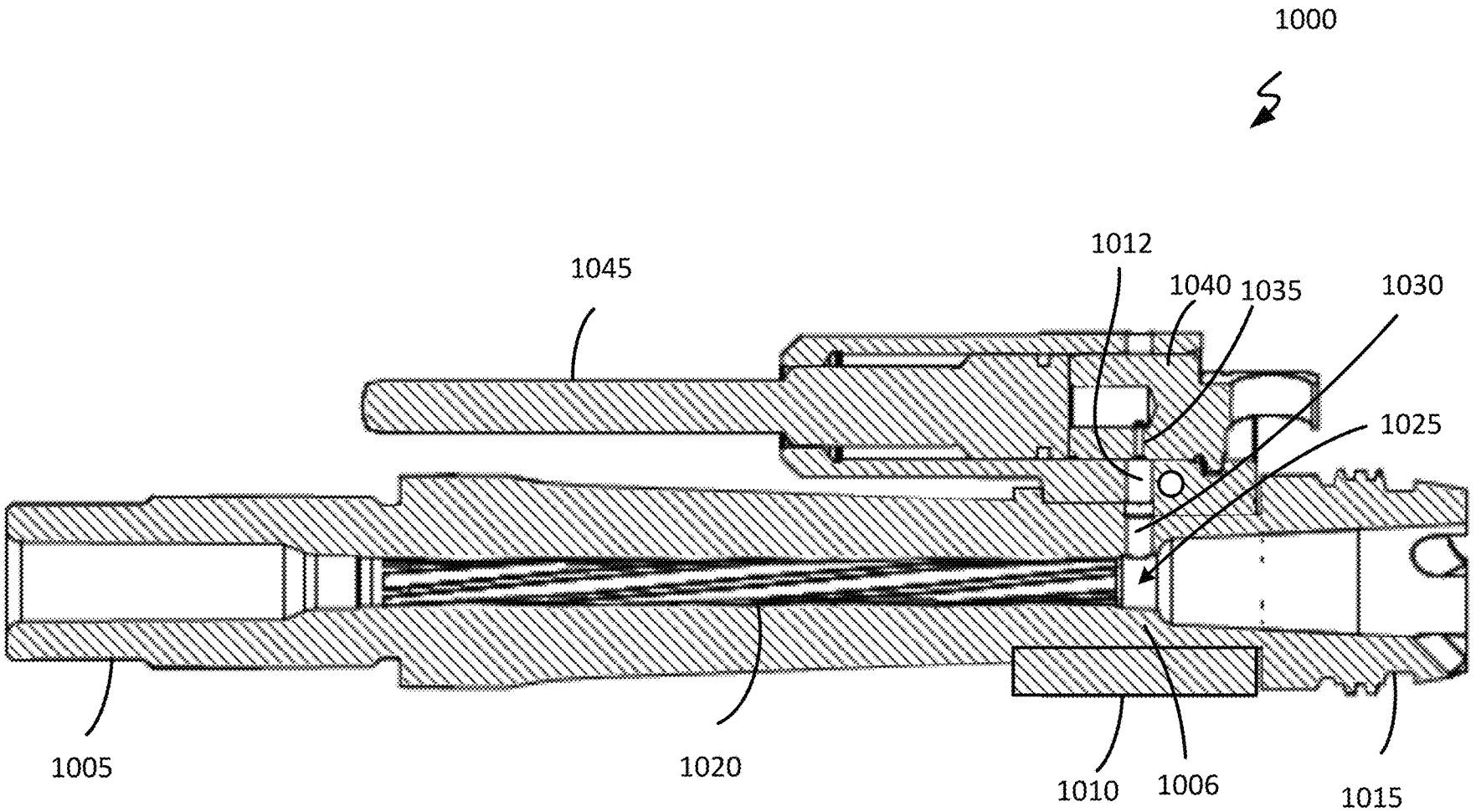
FIG. 10B is a cross-sectional view of the gas operating system shown in FIG. 10A, in accordance with an embodiment of the present disclosure.

FIG. 10A is a perspective view of a gas operating system 1000 for a firearm 100, in which the insert 1015 is external to the barrel 1005, in accordance with another embodiment of the present disclosure. FIG. 10B is a cross-sectional view of the gas operating system 1000 shown in FIG. 10A. In some other examples, the gas block 1010 and the insert 1015 can be attached to an exterior surface of the barrel 1005 to further reduce the overall length of the firearm 100. For example, the gas operating system 1000 includes a barrel 1005 with a gas block 1010 installed thereon, such that the block 1010 surrounds a portion of an exterior surface (or circumference) of the barrel 1005.

As shown in FIG. 10B, for example, with the gas block 1010 positioned on the barrel 1005, the barrel 1005 extends through and distally beyond the gas block 1010 to enable the barrel to receive the insert 1015. The insert 1015 can also be installed onto the outer (or exterior) surface of the barrel 1005, thereby reducing the distance the insert 1015 extends beyond the barrel 1005. The barrel 1005 defines a rifled bore 1020 and a gas expansion chamber 1025 adjacent to the distal end of the rifled bore 1020. Note that the gas expansion chamber 1025 is defined in the distal end portion 1006 of the barrel 1005, such that the gas expansion chamber 1025 is defined by the internal geometry of the barrel 1005 rather than a combination of the barrel 1005, the gas block 1010, and/or the insert 1015. In addition, the barrel 1005 further defines a gas port 1030 in fluid communication with a valve opening 1035 of the gas block 1010, where the gas port 1030 is located at the gas expansion chamber 1025 distally of the rifled portion of the bore 1020. In some such embodiments, the diameter of the gas expansion chamber 1025 is slightly greater than that of the rifled portion of the bore 1020. For example, the diameter of the gas expansion chamber 1025 is sized so that the projectile does not contact the barrel beyond the rifled portion. Distally of the gas expansion chamber 1025, the barrel 1005 may define a greater diameter to allow expansion of gases exiting the barrel 1020. When gases are permitted to expand to a greater extent upon leaving the bore 1020, such as shown in FIG. 10B, the gas expansion chamber 1025 may have a smaller diameter and/or volume so that gas pressure received in the valve effectively cycles the action of the firearm, as will be appreciated. The gas port 1030 is substantially aligned with the valve opening 1035 such that, together, the gas ports 1030 and valve opening 1035 enable the gas expansion chamber 1025 to be in fluid communication with the valve 1040 to operate piston 1045. In some embodiments, the gas block 1010 defines a gas port 1012 between the gas port 1030 of the barrel and the valve opening 1035, such as shown in FIG. 10B. Numerous variations and configurations will be apparent in light of the present disclosure.

Figure 11A:
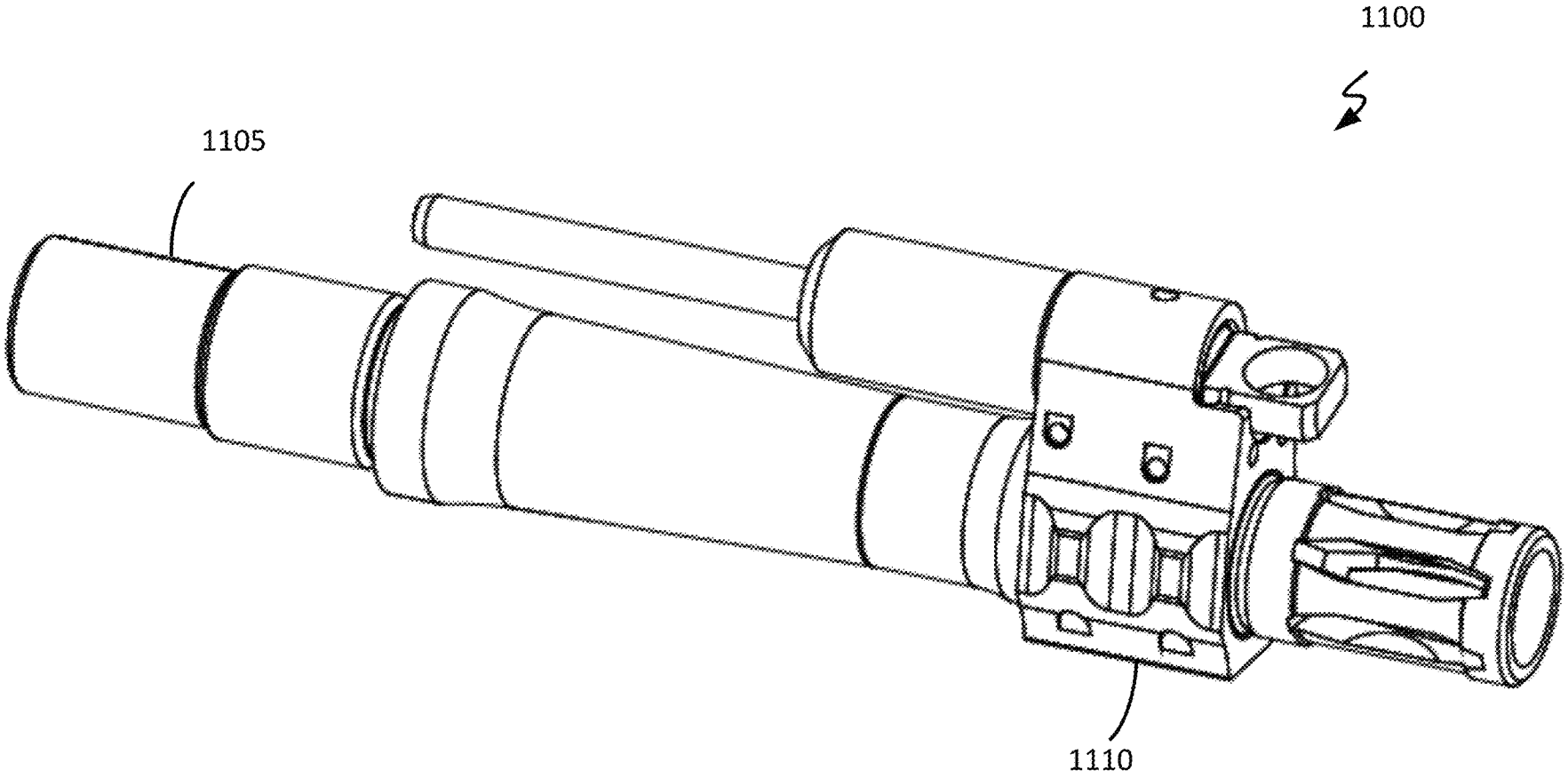
FIG. 11A is a perspective view of a gas operating system without a removable insert for a firearm, in accordance with another embodiment of the present disclosure.
Figure 11B:
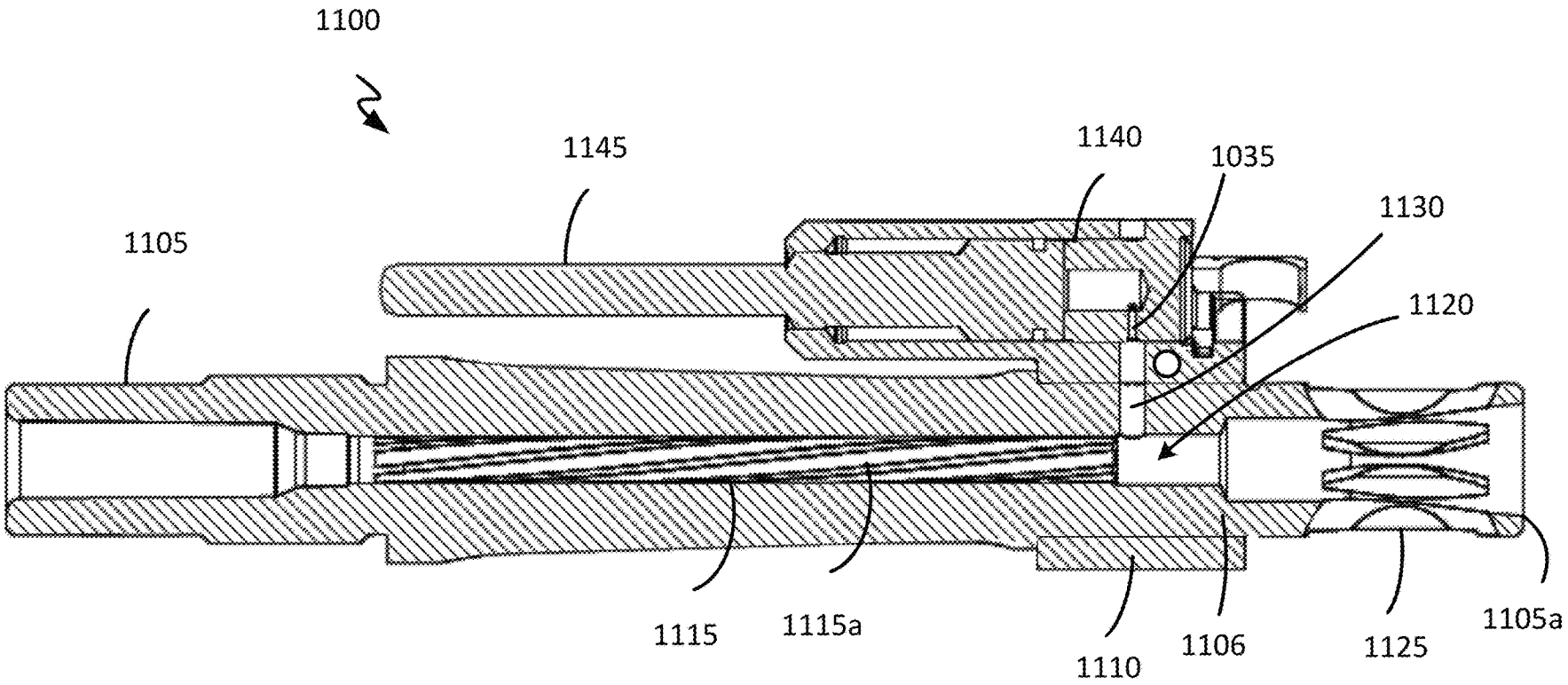
FIG. 11B is a cross-sectional view of the gas operating system shown in FIG. 11A, in accordance with an embodiment of the present disclosure.

FIG. 11A is a perspective view of a gas operating system 1100 for a firearm 100, where the gas operating system lacks a removable insert, in accordance with another embodiment of the present disclosure. FIG. 11B is a cross-sectional view of the gas operating system 1100 shown in FIG. 11A. In some examples, the gas operating system 1100 does not include a separate and removable insert that defines a gas expansion chamber and/or that enhances performance of the firearm 100 (e.g., by reducing muzzle flash). Rather, in some examples, the insert or its equivalent structure is defined in the barrel 1105 and is monolithic with the barrel 1105. For example, gas operating system 1100 includes a barrel 1105 with a gas block 1110 disposed thereon.

As shown in FIG. 11B, for example, the gas block 1110 is concentric with the barrel 1105, such that the block 1110 does not extend beyond the muzzle-end 1105*a* of the barrel 1105. The gas port 1130 and gas block port 1135 provide fluid communication between the gas expansion chamber 1120 and the valve 1140 to operate the piston 1145. In addition, the barrel 1105 includes a bore 1115 and a gas expansion chamber 1120 integrated within the barrel 1005 and distally adjacent to a rifled portion 1115*a* of the bore 1115. As shown in FIG. 11B, for example, the gas expansion chamber 1120 has a greater diameter than the bore 1115. The bore through distal end portion 1106 of the barrel 1105 at points distal of the gas expansion chamber 1120 can have a diameter that is greater than that of the gas expansion chamber, such as along the flash suppressing feature 1125. In some embodiments, the barrel 1105 can optionally include a flash-suppressing feature 1125 integrated into the distal end portion 1106 of the barrel 1105, the flash-suppressing feature 1125 configured to reduce muzzle flash resulting from burning propellant, for example. In some embodiments, the barrel 1105 can be further configured to receive other components, such as a silencer or suppressor, to enhance firearm performance. For example, the outside surface of the distal end portion 1106 of the barrel is threaded to receive an attachment, such as along all or part of the flash suppressing feature 1125. Numerous other insert configurations will be apparent in light of the present disclosure.

Further Considerations

FIGS. 12A-12E are photographs showing stages of erosion of a gas port 1250 in a conventional operating system of a firearm. The gas port in FIGS. 12A-12E is located in the rifled portion of the barrel. The top of each photograph is the down-bore direction (i.e., towards the distal end of the barrel). As previously described, gas port erosion is a particular concern for short-barreled firearms that fire rifle-caliber ammunition, because the gas port 1250 is located near the chamber of the barrel due to the reduced length of the barrel. The reduced distance between the chamber and the gas port causes high pressure, temperature, and/or velocity combustion gases to enter the gas port and thereby rapidly erode the gas port.

Figure 12A:
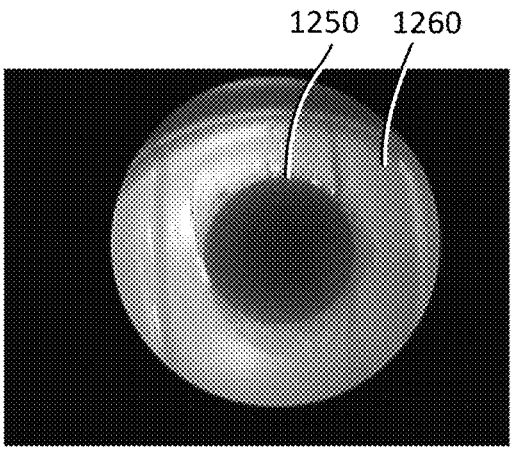
FIG. 12A is a photograph of an opening of a gas port within a barrel of a firearm having a conventional gas operating system. The photograph was recorded prior to firing projectile rounds with the firearm.
Figure 12B:
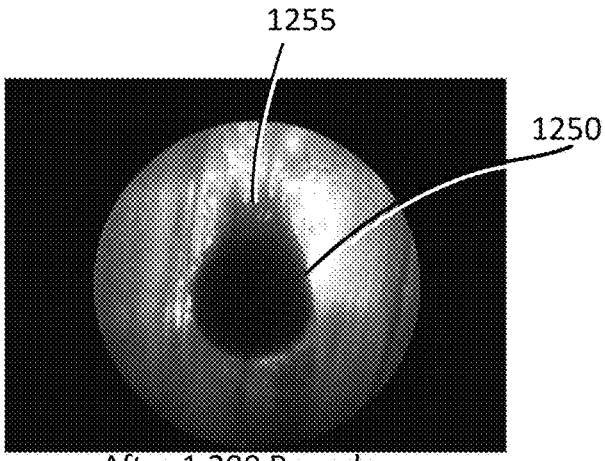
FIG. 12B is a photograph that illustrates erosion of the opening of the gas port shown in FIG. 12A after firing 1,200 rounds of ammunition with the firearm.
Figure 12C:
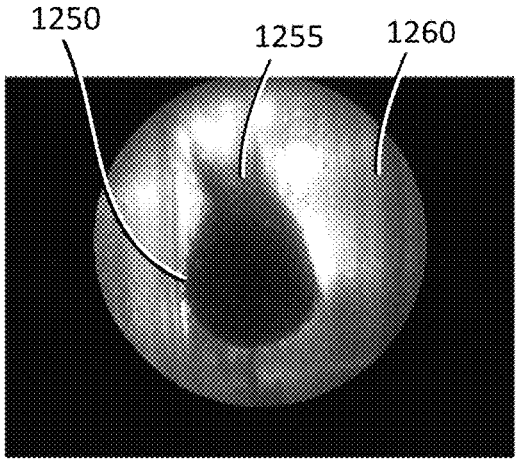
FIG. 12C is a photograph that illustrates erosion of the opening of the gas port shown in FIG. 12A after firing 2,400 rounds of ammunition with the firearm.

FIG. 12A is a photograph looking into the gas port 1250 of a conventional short-barreled firearm as initially machined through the wall of the barrel. In FIG. 12A, the gas port is shown as a dark circle in the center of the lighter-colored region of the inside surface 1260 of the barrel. Note that the gas port 1250 is well-defined with a uniform circular shape, and the inside surface 1260 of the barrel is relatively smooth. After a short period of firearm use, erosion 1255 of the gas port 1250 begins to occur. This erosion 1255 can begin to occur after firing as few as 1,200 to 2,400 rounds from the firearm. As can be seen in FIGS. 12B and 12C, the gas port 1250 no longer has a uniform circular shape, but appears elongated towards the down-barrel side of the gas port 1250. In addition, the inside surface 1260 of the barrel includes grooves and other surface defects 1270 caused by gases and particles moving at high temperature, high pressure, and high velocity across and into the gas port 1250.

Figure 12D:
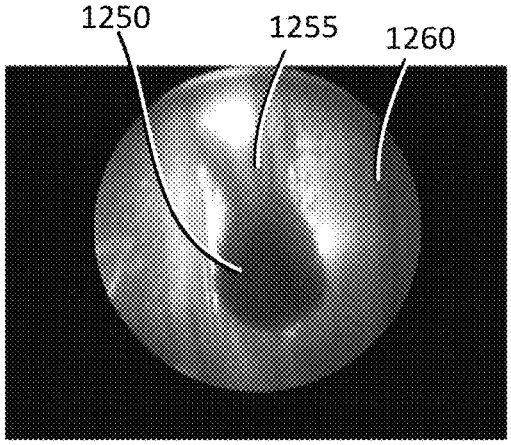
FIG. 12D is a photograph that illustrates erosion of the opening of the gas port shown in FIG. 12A after firing 3,600 rounds of ammunition with the firearm.
Figure 12E:
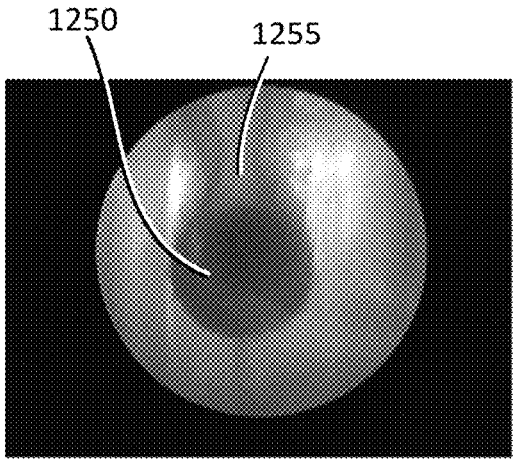
FIG. 12E is a photograph that illustrates erosion of the opening of the gas port shown in FIG. 12A after firing 4,800 rounds of ammunition with the firearm.
Figure 12F:
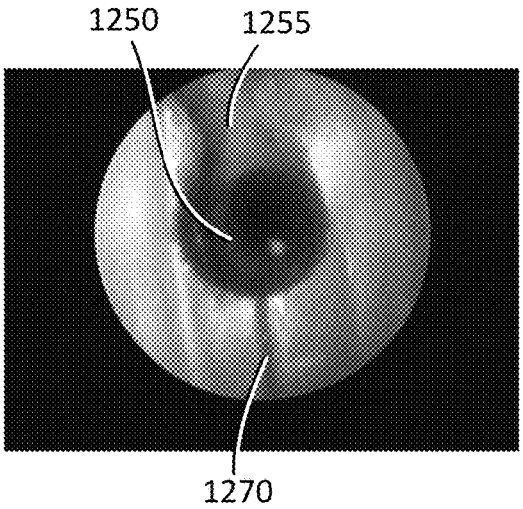
FIG. 12F is a photograph that illustrates erosion of the opening of the gas port shown in FIG. 12A after firing 6,000 rounds of ammunition with the firearm.

Further erosion 1255 of the gas port 1250 occurs with additional use. For example, as shown in FIGS. 12D-12F, after firing 3,600 to 6,000 rounds, the gas port 1250 is further eroded. This erosion 1255 adversely affects firearm performance and accuracy, as previously described herein. In FIGS. 12D-12F, the opening to the gas port 1250 is significantly deformed, such that the gas port no longer has its initial machined diameter. In addition to erosion 1255 on the down-barrel side of the gas port 1250, a recess is defined around the gas port 1250 that provides a larger effective entrance to the gas port 1250, such as shown in FIG. 12F. The enlarged entrance to the gas port can allow more gases than needed (or desired) to flow into the gas operating system, thereby causing the system to operate faster than designed. The faster movement of system components can cause increased wear and/or damage to the components as the forces applied to individual components can increase. In addition, significant amount of surface material has been removed from the inside surface 1260 of the barrel, such that the interface between the projectile and the barrel has been impaired, thereby adversely affecting the flight of the projectile and/or accuracy of the firearm.

Figure 13A:
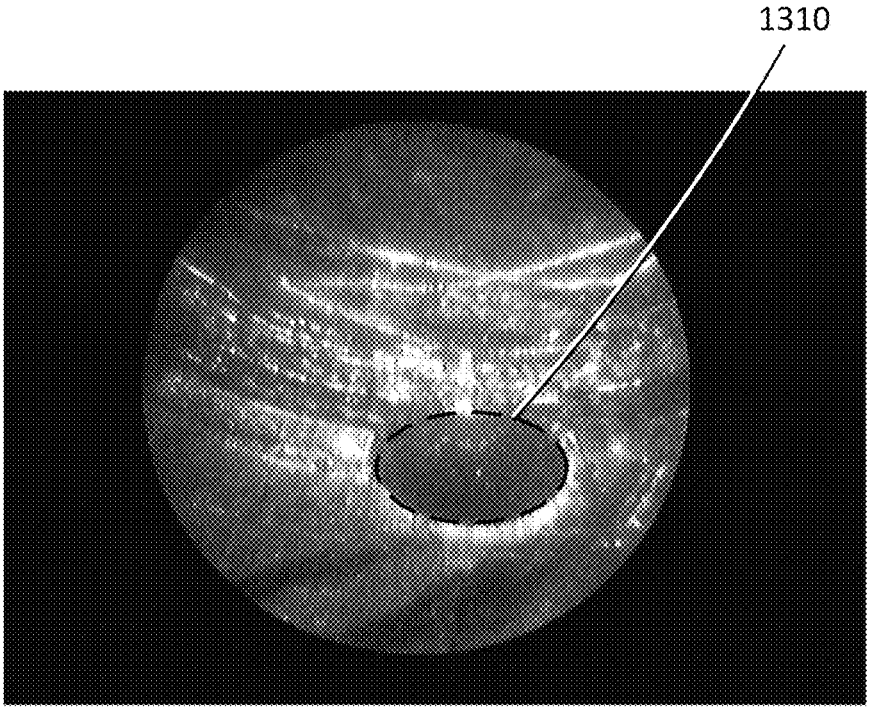
FIG. 13A is a photograph showing an angled view of an opening of a gas port of a gas operating system after firing 5,000 rounds of ammunition, in accordance with an embodiment of the present disclosure.
Figure 13B:
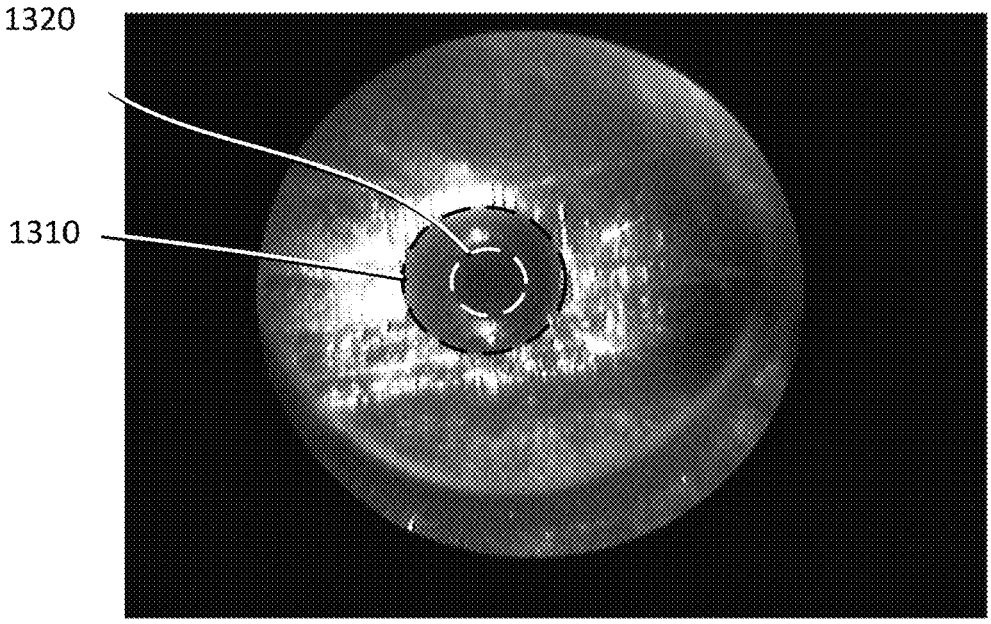
FIG. 13B is another photograph showing the opening of the gas port shown in FIG. 13A as viewed looking into the gas port, in accordance with an embodiment of the present disclosure.

In contrast, the gas operating system of the present disclosure does not experience similar erosion. Rather, the gas port experiences very little (if any) erosion of the gas port after significant use of the firearm. FIGS. 13A-13B are example photographs of a gas port 1310 after firing 5,000 rounds, where the gas port 1310 is located in the gas expansion chamber. FIG. 13A shows the gas port 1310 as viewed at an angle using a borescope. FIG. 13B is a view looking into the gas port 1310 and also shows the smaller valve port 1320. In both FIGS. 13A-13B the entrance to the gas port 1310 shows little or no erosion. Also, the shape of the gas port 1310 is substantially maintained. This is particularly noticeable in FIG. 13B, in which the photograph illustrates that the gas port 1310 maintains a substantially uniform diameter as initially machined.

EXAMPLE EMBODIMENTS

The following examples pertain to further embodiments, from which numerous permutations and configurations will be apparent.

Example 1 is a gas operating system for a firearm, the system comprising a barrel extending from a proximal end to a distal end, the barrel defining a bore extending therethrough along a bore axis, the bore including a rifled bore portion with a first bore diameter; and a gas block attached to a distal end portion of the barrel; wherein the gas operating system defines a gas expansion chamber located distally of the rifled bore portion, the gas expansion chamber in fluid communication with the bore and the gas block and having a chamber diameter greater than the first bore diameter.

Example 2 includes the subject matter of Example 1, wherein the gas expansion chamber is defined within the gas block.

Example 3 includes the subject matter of Example 2 and further comprises an insert attached to the gas block, the insert positioned to define at least one end of the gas expansion chamber and aligned with the bore axis such that a projectile moves through the rifled bore portion, the gas expansion chamber, and the insert during a firing cycle.

Example 4 includes the subject matter of Example 3, wherein the insert receives part of the projectile before the projectile completely exits the rifled portion of the bore during a firing cycle of the firearm.

Example 5 includes the subject matter of Example 3 or 4, wherein the insert is disposed completely within the gas block and adjacent to the distal end the barrel.

Example 6 includes the subject matter of any of Examples 3-5, wherein the insert has a proximal end portion defining one or more control surfaces configured to re-direct a flow of combustion gases during a firing cycle of the firearm.

Example 7 includes the subject matter of any of Examples 3-4 and 6, wherein the insert is further configured to reduce muzzle flash during a firing cycle of the firearm.

Example 8 includes the subject matter of any of Examples 3-4 and 6-8, wherein the insert is further configured to receive at least one additional firearm component.

Example 9 includes the subject matter of Example 1, wherein the gas block includes a piston, and the gas block defines a gas block port located adjacent to a distal end of the rifled bore portion, wherein the gas block port is in direct communication with the gas expansion chamber and wherein the piston is configured to move in response to receiving gases from the barrel via the gas expansion chamber and the gas block port.

Example 10 includes the subject matter of Example 9, wherein a distal end portion of the barrel defines the gas expansion chamber located distally of the rifled bore portion, and defines a gas port in communication with the gas expansion chamber and the gas block port.

Example 11 includes the subject matter of Example 10, wherein the barrel comprises a second bore distally adjacent the rifled bore portion, the second bore defining the gas expansion chamber and having a second bore diameter greater than the first bore diameter.

Example 12 includes the subject matter of Example 11, wherein the distal end portion of the barrel further defines a third bore located distally of the second bore, the third bore having a third bore diameter greater than the second bore diameter.

Example 13 includes the subject matter of any of Examples 1-12, wherein the barrel has a length from 5 to 9 inches.

Example 14 includes the subject matter of any of Examples 1-13, wherein the firearm is chambered for 5.56× 45 mm ammunition.

Example 15 includes the subject matter of Example 14, wherein the gas expansion chamber has an axial length less than an axial length of a projectile of the ammunition.

Example 16 includes the subject matter of any of Examples 1-15, wherein the chamber diameter at least twice the bore diameter.

Example 17 is a gas operating system for a firearm, the system comprising a gas block defining a first cylinder, a second cylinder in fluid communication with the first cylinder, and a gas port in direct communication with the first cylinder; and a barrel extending longitudinally and defining a bore with a bore diameter, the barrel having a distal end portion with a distal barrel end, wherein the distal end portion of the barrel is received in the first cylinder with the distal barrel end positioned proximally of the gas port; wherein the first cylinder is in fluid communication with the bore via the gas port.

Example 18 includes the subject matter of Example 17, wherein the distal barrel end and part of the first cylinder define a gas expansion chamber in fluid communication with the gas port.

Example 19 includes the subject matter of Example 18 or 19 and further comprises an insert installed in a distal portion of the first cylinder, the insert axially spaced from the distal barrel end to define a gas expansion chamber therebetween, wherein the chamber is in direct fluid communication with the gas port.

Example 20 includes the subject matter of Example 19, wherein the insert includes a proximal end portion that defines a control surface configured to re-direct a flow of combustion gases within the gas expansion chamber.

Example 21 includes the subject matter of Examples 19 or 20, wherein the insert is configured to reduce muzzle flash.

Example 22 includes the subject matter of Example 18 and further comprises an insert disposed within the first cylinder distally of the distal barrel end, the insert configured and positioned to define a gas expansion chamber adjacent the distal barrel end, wherein the gas expansion chamber is in direct fluid communication with the gas port and the gas expansion chamber has a chamber diameter greater than the bore diameter.

Example 23 includes the subject matter of Example 22, wherein the insert is disposed within the gas block such that an opening within the gas block forms a muzzle-end of the firearm.

Example 24 includes the subject matter of Examples 22 or 23, wherein a distal end portion of the insert extends proximally into the gas expansion chamber and defines a projectile pathway therethrough.

Example 25 includes the subject matter of Example 24, wherein an entrance to the projectile pathway is less than 0.75 inch from the distal barrel end.

Example 26 includes the subject matter of any of Examples 18-25, wherein the barrel has a length from 5 to 9 inches.

Example 27 includes the subject matter of any of Examples 18-26, wherein the chamber diameter is at least twice the bore diameter.

Example 28 includes the subject matter of any of Examples 18-27, wherein the gas expansion chamber has an axial length of less than one inch.

Example 29 includes the subject matter of Example 28, wherein the axial length is less than 0.75 inch.

Example 30 includes the subject matter of Example 28, wherein the axial length is less than 0.5 inch.

Example 31 includes the subject matter of any of Examples 18-30 and further comprises a gas valve and a piston in the second cylinder, the piston configured to move in response to receiving gases from the bore via the gas port.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. A gas operating system for a firearm chambered for ammunition having a projectile length of at least 0.75 inch, the system comprising:

a gas block defining a first cylinder and a second cylinder in fluid communication with the first cylinder via a gas port between the first cylinder and the second cylinder;

an insert in a distal end portion of the first cylinder, the insert defining a central projectile pathway therethrough; and a barrel extending longitudinally and defining a bore with a bore diameter, the barrel having a distal end portion with a distal barrel end, wherein the distal end portion of the barrel is received in a proximal portion of the first cylinder with the distal barrel end positioned proximally of the gas port;

wherein the first cylinder defines a gas expansion chamber between the distal barrel end and the insert, wherein an axial distance from the distal barrel end to a proximal end of the central projectile pathway is less than 0.75 inch, and wherein the gas expansion chamber is in fluid communication with the gas port and has a chamber diameter that is greater than the bore diameter and greater than a diameter of the central projectile pathway.

2. The gas operating system of claim 1, wherein the insert includes a control surface surrounding the central projectile pathway, the control surface inclined with respect to the bore axis and configured to re-direct a flow of combustion gases away from the bore axis.

3. The gas operating system of claim 1, wherein the insert is configured to reduce muzzle flash.

4. The gas operating system of claim 1, wherein a distal end of the insert defines a distal end of the firearm.

5. The gas operating system of claim 1, wherein the barrel has a length from 5 to 9 inches.

6. The gas operating system of claim 1, wherein the chamber diameter is at least twice the bore diameter.

7. The gas operating system of claim 1, wherein the axial distance is less than 0.50 inch.

8. The gas operating system of claim 7, wherein the firearm is chambered for 5.56×45 mm ammunition.

9. The gas operating system of claim 1, wherein the end cap is threaded into a distal end portion of the first cylinder and includes a three-prong flash hider.

10. The gas operating system of claim 1 further comprising a gas piston partially received in the second cylinder, the piston movable to initiate reloading of the firearm.

11. The gas operating system of claim 1, wherein the gas expansion chamber has a volume of at least 0.140 cubic inches.

* * * * *